US010953524B2

(12) United States Patent
Sako et al.

(10) Patent No.: US 10,953,524 B2
(45) Date of Patent: Mar. 23, 2021

(54) IMPACT FASTENING TOOL

(71) Applicant: MAKITA CORPORATION, Anjo (JP)

(72) Inventors: Masahiko Sako, Anjo (JP); Takaaki Osada, Anjo (JP); Hirokatsu Yamamoto, Anjo (JP)

(73) Assignee: MAKITA CORPORATION, Anjo (JP)

( * ) Notice: Subject to any disclaimer, the term of this patent is extended or adjusted under 35 U.S.C. 154(b) by 232 days.

(21) Appl. No.: 15/928,788

(22) Filed: Mar. 22, 2018

(65) Prior Publication Data

US 2018/0272511 A1 Sep. 27, 2018

(30) Foreign Application Priority Data

Mar. 23, 2017 (JP) ..... JP2017-057328

(51) Int. Cl.
*B25B 21/02* (2006.01)
*B25B 23/147* (2006.01)
*B25B 23/14* (2006.01)

(52) U.S. Cl.
CPC ..... *B25B 21/02* (2013.01); *B25B 23/1405* (2013.01); *B25B 23/1475* (2013.01)

(58) Field of Classification Search
USPC ..... 173/4
See application file for complete search history.

(56) References Cited

U.S. PATENT DOCUMENTS 5,277,261 A 1/1994 Sakoh
5,289,885 A 3/1994 Sakoh
5,361,852 A * 11/1994 Inoue ..... B23P 19/066 173/176
5,402,688 A * 4/1995 Okada ..... B25B 23/14 73/862.21
7,036,703 B2 * 5/2006 Grazioli ..... B25B 27/0085 227/10

(Continued)

FOREIGN PATENT DOCUMENTS

JP H06-170740 A 6/1994
JP 2005-118911 A 5/2005

OTHER PUBLICATIONS

Aug. 30, 2018 Extended European Search Report issued in European Patent Application No. 18163463.5.

(Continued)

*Primary Examiner* — Anna K Kinsaul
*Assistant Examiner* — Chinyere J Rushing-Tucker
(74) *Attorney, Agent, or Firm* — Oliff PLC

(57) ABSTRACT

An impact fastening tool may include a motor; a hammer configured to be rotationally driven by the motor; an anvil configured to be hit in a rotational direction by the hammer; a signal obtainer configured to obtain a variable signal which varies in accordance with a hit to the anvil by the hammer; and a seating determiner configured to determine whether or not a fastener has been seated based on the variable signal obtained by the signal obtainer, wherein the seating determiner is configured to determine whether or not the fastener has been seated based on a signal component of the variable signal obtained by the signal obtainer, the signal component corresponding to a predetermined reference frequency.

14 Claims, 21 Drawing Sheets

(56) References Cited

U.S. PATENT DOCUMENTS

| | | | | |
|---|---|---|---|---|
| 2005/0045353 | A1* | 3/2005 | Kawai | B25B 21/02 173/181 |
| 2005/0109519 | A1* | 5/2005 | Kawai | B25B 23/1405 173/183 |
| 2005/0109520 | A1* | 5/2005 | Kawai | G05D 17/02 173/183 |
| 2005/0263303 | A1* | 12/2005 | Shimizu | B25B 23/1475 173/2 |
| 2006/0185869 | A1* | 8/2006 | Arimura | B25B 23/1475 173/176 |
| 2009/0014192 | A1* | 1/2009 | Ito | B23P 19/066 173/1 |
| 2011/0114346 | A1 | 5/2011 | Suzuki et al. | |
| 2014/0262390 | A1* | 9/2014 | Arimura | H02P 7/295 173/7 |
| 2015/0135907 | A1 | 5/2015 | Hirabayashi et al. | |
| 2016/0121467 | A1* | 5/2016 | Ng | B25B 21/026 173/176 |
| 2016/0325414 | A1 | 11/2016 | Mizuno et al. | |
| 2017/0057064 | A1* | 3/2017 | Ishikawa | B25B 23/1475 |
| 2017/0217001 | A1* | 8/2017 | Oishi | B25B 21/02 |

OTHER PUBLICATIONS

Jul. 30, 2020 Office Action issued in European Application No. 18163463.5.

* cited by examiner

IMPACT FASTENING TOOL

TECHNICAL FIELD

A technique disclosed herein relates to an impact fastening tool.

BACKGROUND

Japanese Patent Application Publication No. 2005418911 describes an impact fastening tool provided with a motor, a hammer configured to be rotationally driven by the motor, an anvil configured to be hit in a rotational direction by the hammer, and a seating determiner configured to determine whether a fastener has been seated or not.

SUMMARY

In the impact fastening tool of Japanese Patent Application Publication No. 2005-118911, whether a fastener has been seated or not is determined based on a rotation angle of the motor or a torque variation ratio thereof with respect to elapsed time. Upon calculating this torque variation ratio, the impact fastening tool of Japanese Patent Application Publication No. 2005-118911 firstly calculates a difference between moving mean values of tightening torque to obtain a torque variation quantity, and further calculates a difference between moving mean values of the torque variation quantity to obtain the torque variation ratio. In this case, a high-resolution torque sensor and a high-spec calculator need to be used in order to suppress an increase in errors resulted from influence of noise and cancellation of significant digits. A technique capable of accurately determining seating of a fastener with a small calculation load is being desired.

An impact fastening tool disclosed herein may comprise a motor, a hammer configured to be rotationally driven by the motor, an anvil configured to be hit in a rotational direction by the hammer, a signal obtainer configured to obtain a variable signal which varies in accordance with a hit to the anvil by the hammer, and a seating determiner configured to determine whether or not a fastener has been seated based on a signal component of the variable signal obtained by the signal obtainer. The signal component may correspond to a predetermined reference frequency.

FIGS. 20 and 21 show how an anvil A of the impact fastening tool rotates when hit by the hammer. FIGS. 20 and 21 show a case where the anvil A is provided with two blades B1, B2 which are apart from each other by 180 degrees. As shown in FIG. 20, in a case where the fastener has not been completely tightened yet and the fastener can still rotate, when the hammer hits the blade B1 of the anvil A, the anvil A rotates in accordance with the hit. Due to this, by the time the hammer comes to hit the other blade B2 of the anvil A thereafter, the hammer rotates by an angle larger than 180 degrees. Therefore, in this case, a frequency with which the hammer hits the anvil A (a hitting frequency) becomes lower than a frequency obtained by multiplying a rotational frequency of the hammer by the number of the blades. Contrary to this, as shown in FIG. 21, in a case where the fastener has been completely tightened and the fastener cannot rotate any more, the anvil A does not rotate even when the hammer hits the blade B1. Due to this, by the time the hammer comes to hit the other blade B2 of the anvil A thereafter, the hammer rotates by an angle of 180 degrees. Therefore, in this case, the hitting frequency of the hammer is equal to the frequency obtained by multiplying the rotational frequency of the hammer by the number of the blades. As such, the hitting frequency of the hammer varies depending on states of the fastener.

As shown in FIG. 22, hitting frequencies f1, f2 of the hammer before the fastener has been seated increase while exhibiting fluctuating trends due to an influence of galling which results from a coating material adhering on a threaded portion of the fastener. Then, the hitting frequencies f1, f2 of the hammer after the fastener has been seated gradually approach specific frequencies F1, F2. In the aforementioned impact fastening tool, seating determination for the fastener is performed, focusing on such a difference in behaviors of the hitting frequency of the hammer before and after the fastener has been seated.

In the aforementioned impact fastening tool, the signal obtainer obtains the variable signal which varies in accordance with a hit to the anvil by the hammer, and the seating determiner determines whether the fastener has been seated or not based on the signal component of the variable signal corresponding to the reference frequency. Such obtaining process of a variable signal and determination process based on a specific signal component do not require a very large calculation load. According to the aforementioned impact fastening tool, seating of a fastener can be accurately determined with a small calculation load.

DETAILED DESCRIPTION

Representative, non-limiting examples of the present invention will now be described in further detail with reference to the attached drawings. This detailed description is merely intended to teach a person of skill in the art further details for practicing preferred aspects of the present teachings and is not intended to limit the scope of the invention. Furthermore, each of the additional features and teachings disclosed below may be utilized separately or in conjunction with other features and teachings to provide improved impact fastening tools, as well as methods for using and manufacturing the same.

Moreover, combinations of features and steps disclosed in the following detailed description may not be necessary to practice the invention in the broadest sense, and are instead taught merely to particularly describe representative examples of the invention. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other fix the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

In one or more embodiments, the predetermined reference frequency may be set in accordance with a rotational speed of the hammer.

As aforementioned, a hitting frequency of the hammer is lower than a frequency obtained by multiplying a rotational frequency of the hammer by the number of blades in a case where the fastener can rotate, whereas the hitting frequency is equal to the frequency obtained by multiplying the rotational frequency of the hammer by the number of blades in a state where the fastener cannot rotate any more. Therefore, the frequency which is gradually approached after the fastener has been seated is a frequency in accordance with the rotational speed of the hammer. According to the above configuration, whether the fastener has been seated or not can be determined accurately by setting the predetermined reference frequency in accordance with the rotational speed of the hammer.

In one or more embodiments, the predetermined reference frequency may be changeable in accordance with a material of a fastened member.

Figure 22:
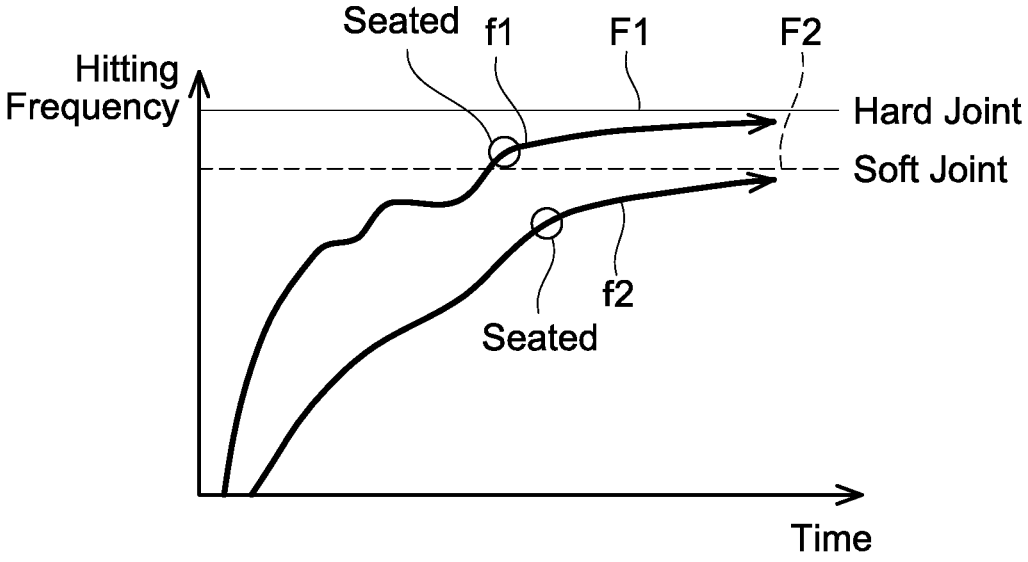
FIG. 22 is a diagram showing an example of chronological changes in hitting frequencies of the hammer in a ease where a material of a fastened member is hard and in a case where the material of the fastened member is soft.

As shown in FIG. 22, in a case where a fastened member is constituted of a hard material (in a case of a hard joint in FIG. 22), when the fastener is tightened after having seated, the fastened member is barely deformed with the tightening of the fastener. Thus, in this case, a hitting frequency f1 of the hammer gradually approaches a frequency F1 which is obtained by multiplying the rotational frequency of the hammer by the number of blades of an anvil. Contrary to this, in a case where the fastened member is constituted of a soft material (in a case of a soft joint in FIG. 22), When the fastener is tightened after having seated, the fastened member is deformed with the tightening of the fastener. Thus, in this case, a hitting frequency f2 of the hammer gradually approaches a frequency F2 which is lower than the frequency F1 obtained by multiplying the rotational frequency of the hammer by the number of blades of the anvil. According to the above configuration, the predetermined reference frequency is changeable in accordance with the material of the fastened member, and thus whether the fastener has been seated or not can be determined accurately.

In one or more embodiments, the seating determiner may include a filter configured to allow a frequency band including the predetermined reference frequency to pass therethrough for the variable signal.

According to the above configuration, a signal component of the variable signal which corresponds to the predetermined reference frequency can be extracted with a small calculation load.

In one or more embodiments, the filter may be configured to selectively amplify the frequency band including the predetermined reference frequency.

According to the above configuration, the signal component corresponding to the predetermined reference frequency can be accentuated, and thus whether the fastener has been seated or not can be determined more accurately.

In one or more embodiments, the seating determiner may include a frequency converter configured to perform a frequency conversion for the variable signal. The frequency converter may include a reference signal generator configured to generate a reference signal having a frequency equal to or higher than the predetermined reference frequency, and a multiplier configured to multiply the variable signal by the reference signal.

According to the above configuration, the signal component of the variable signal corresponding to the predetermined reference frequency can be processed with a small calculation load by heterodyning the variable signal and the reference signal.

In one or more embodiments, the seating determiner may include an envelope detector configured to detect an envelope of the variable signal and to output it as an evaluation signal.

According to the above configuration, a determination process for whether the fastener has been seated or not can be performed with a small calculation load.

In one or more embodiments, the seating determiner may include a first reference signal generator configured to generate a first reference signal having a frequency equal to or higher than the predetermined reference frequency, a first multiplier configured to multiply the variable signal by the first reference signal, a second reference signal generator configured to generate a second reference signal having a frequency same as the frequency of the first reference signal and having a phase shifted by 90 degrees with respect to a phase of the first reference signal, a second multiplier configured to multiply the variable signal by the second reference signal, and an envelope detector configured to detect an envelope of the variable signal and to output it as an evaluation signal, based on an output signal of the first multiplier and an output signal of the second multiplier.

According to the above configuration, the determination process for whether the fastener has been seated or not can be performed with a small calculation load.

In one or more embodiments, the seating determiner may further include a tracking signal generator configured to generate a tracking signal which tracks the evaluation signal. The seating determiner may be configured to tentatively determine that the fastener has been seated each time the tracking signal reaches the evaluation signal, and to determine, in a case where the evaluation signal satisfies a predetermined determination criterion after it was tentatively determined that the fastener had been seated last time, that the fastener was seated at a time when it was tentatively determined that the fastener had been seated the last time.

As aforementioned, the hitting frequency of the hammer before the fastener has been seated increases while exhibiting fluctuating trends due to influence of galling which results from a coating material and the like adhering on the threaded portion of the fastener. Then, the hitting frequency of the hammer after the fastener has been seated gradually approaches a specific frequency gradually. According to the above configuration, the seating determiner can be prevented from erroneously determining that the fastener has been seated before the fastener has actually been seated.

In one or more embodiments, the seating determiner may be configured to generate a deviation signal by calculating a deviation between the evaluation signal and the tracking signal, and to tentatively determine that the fastener has been seated each time the deviation signal becomes equal to or less than a predetermined threshold.

According to the above configuration, a tentative determination for seating of the fastener can be performed with a small calculation load.

In one or more embodiments, the seating determiner may be configured to generate a variable threshold signal based on the evaluation signal and the deviation signal, and to determine that the fastener has been seated, in a case where a deviation between the evaluation signal and the variable threshold signal becomes equal to or greater than a predetermined value after it was tentatively determined that the fastener had been seated.

According to the above configuration, whether the fastener has been seated or not can be determined accurately with a small calculation load.

In one or more embodiments, the computer may be configured to generate a variable threshold signal based on the evaluation signal and the deviation signal, and to determine that the fastener has been seated, when a deviation between the deviation signal and the variable threshold signal becomes equal to or greater than a predetermined value after it was tentatively determined that the fastener had been seated.

According to the above configuration, the motor stopper resets the stop determination value each time it is tentatively determined that the fastener has been seated. After that, when it is no longer tentatively determined that the fastener has been seated, that is, when it is determined that the fastener was seated at the time when it was tentatively determined the last time that the fastener had been seated, the motor stopper stops the motor based on the stop determination value. According to the above configuration, a count of the stop determination value of the motor can be started with a timing of the seating of the fastener as its starting point.

In one or more embodiments, the motor stopper may be configured to stop the motor in a case where it is determined that the fastener has been seated and the stop determination value has reached a predetermined value.

According to the above configuration, a stop determination for the motor can be performed accurately.

In one or more embodiments, the signal obtainer may include a current sensor configured to detect a magnitude of a current flowing through the motor. The variable signal may be obtained based on an output of the current sensor.

According to the above configuration, whether the fastener has been seated or not can be determined accurately based on the current flowing through the motor.

In one or more embodiments, the signal obtainer may include a rotational speed sensor configured to detect a rotational speed of the motor. The variable signal may be obtained based on an output of the rotational speed sensor.

According to the above configuration, whether the fastener has been seated or not can be determined accurately based on the rotational speed of the motor.

In one or more embodiments, the signal obtainer may include an acceleration sensor configured to detect vibration generated when the hammer hits the anvil. The variable signal may be obtained based on an output of the acceleration sensor.

According to the above configuration, whether the fastener has been seated or not can be determined accurately based on the output of the acceleration sensor.

In one or more embodiments, the signal obtainer may include a microphone configured to detect sound generated when the hammer hits the anvil. The variable signal may be obtained based on an output of the microphone.

According to the above configuration, whether the fastener has been seated or not can be determined accurately based on the output of the microphone.

First Embodiment

Figure 1:
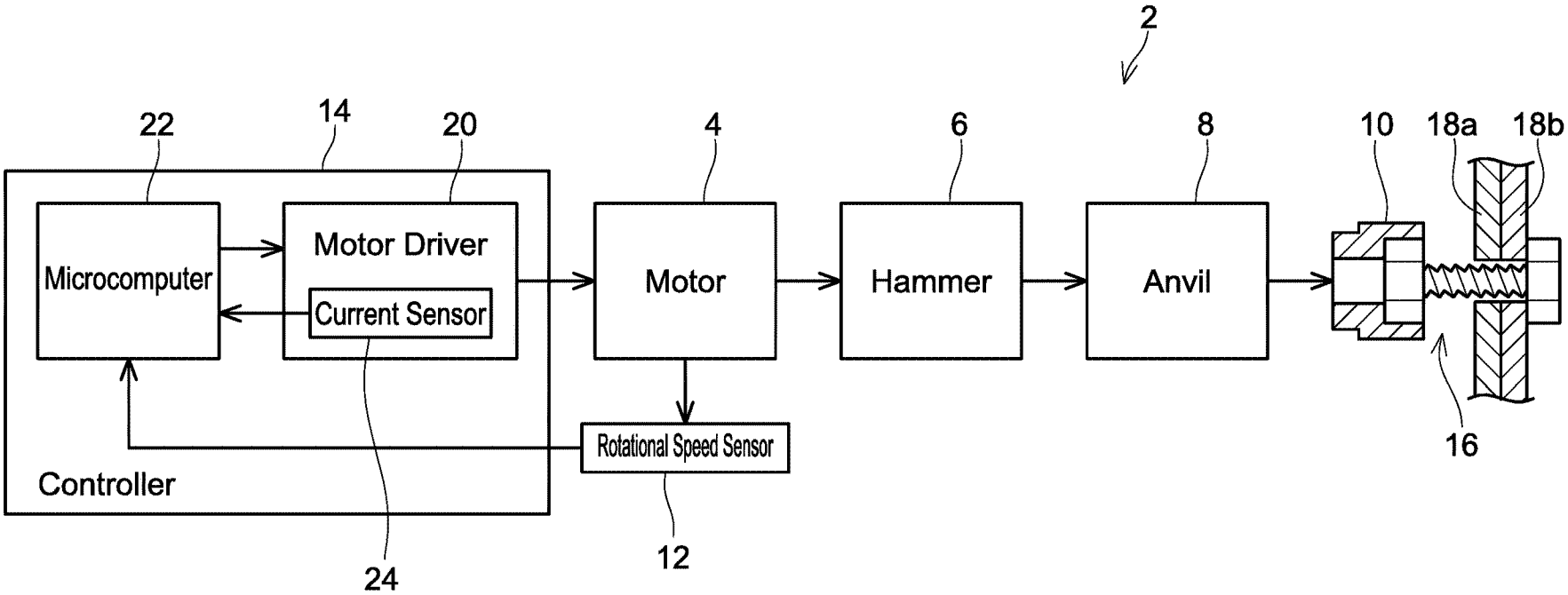
FIG. 1 is a block diagram schematically showing a configuration of an impact fastening tool 2 of a first embodiment.

FIG. 1 schematically shows a configuration of an impact fastening tool 2 of an embodiment. The impact fastening tool 2 comprises a motor 4, a hammer 6 configured to be rotationally driven by the motor 4, an anvil 8 configured to be hit in a rotational direction by the hammer 6, a bit 10 attached to the anvil 8, a rotational speed sensor 12 configured to detect a rotational speed of the motor 4, and a controller 14. The impact fastening tool 2 fastens fastened members 18*a*, 18*b* by tightening a fastener 16 via the bit 10. In the present embodiment, the fastener 16 is a bolt and a nut, and the bit 10 is a socket bit configured to rotate the nut. Further, in the present embodiment, "the fastener 16 is seated" means that a seating surface of the nut makes contact with a nut-side surface of the fastened member 18*a*. In the present embodiment, the anvil 8 includes two blades with an interval of 180 degrees provided between the two blades in a rotational direction, and the hammer 6 includes two hitting pieces which correspond to the two blades of the anvil 8. It should be noted that the fastener 16 to be tightened by the impact fastening tool 2 is not limited to a bolt and a nut, and may be a screw such as a wood screw and the like. In this case, the bit 10 is a driver bit configured to rotate the screw, and "the fastener 16 is seated" means that a seating surface of a head of the screw makes contact with a screw-side surface of the fastened member 18*a*.

The controller 14 comprises a motor driver 20 configured to drive the motor 4, and a microcomputer 22 configured to control an operation of the motor 4 by outputting a motor control signal to the motor driver 20. The motor driver 20 comprises a current sensor 24 configured to detect a current flowing through the motor 4.

Figure 2:
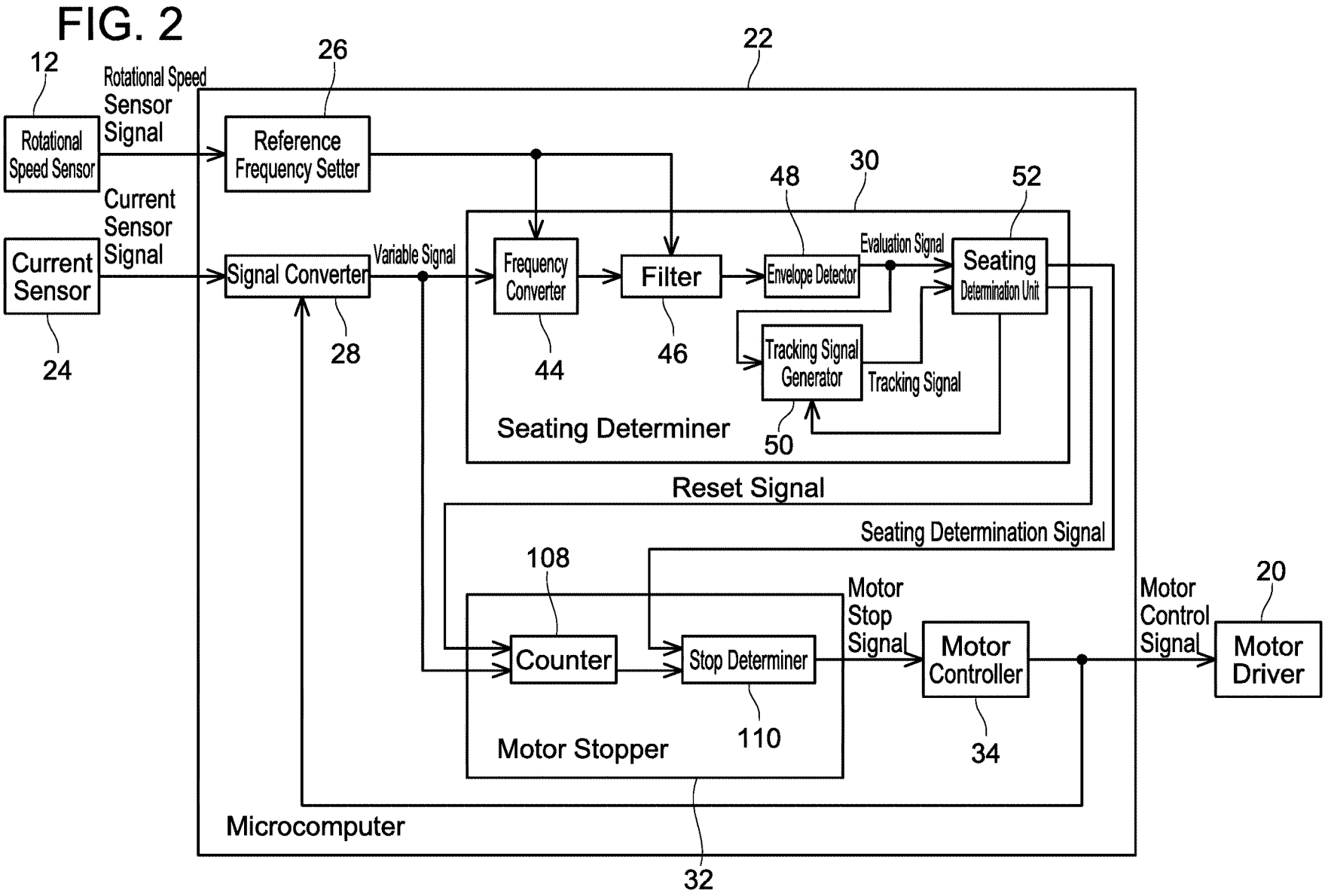
FIG. 2 is a block diagram schematically showing a configuration of a microcomputer 22 of the impact fastening tool 2 of the first embodiment.

As shown in FIG. 2, the microcomputer 22 comprises a reference frequency setter 26, a signal converter 28, a seating determiner 30, a motor stopper 32, and a motor controller 34. The microcomputer 22 can be implemented as a processer that comprises hardware, software, or a combination of hardware and software for realizing functions of the above units. In the impact fastening tool 2 of the present embodiment, the microcomputer 22 is a single-chip microcomputer configured to realize the functions of those units.

The reference frequency setter 26 sets a reference frequency based on a rotational speed sensor signal from the rotational speed sensor 12. In the impact fastening tool 2 of the present embodiment, the reference frequency setter 26 obtains a rotational speed of the motor 4 from the rotational speed sensor signal, and calculates a rotational speed of the hammer 6 from the rotational speed of the motor 4. Then, the reference frequency setter 26 outputs a frequency which is twice the rotational speed of the hammer 6, as the reference frequency.

The impact fastening tool 2 may comprise a switch (not shown) by which a user can select materials of fastened members 18*a*, 18*b*. In this case, in a case where the materials of the fastened members 18*a*, 18*b* which are selected by the switch are hard, the reference frequency setter 26 uses the reference frequency as it is, which is calculated based on the rotational speed sensor signal as described above. In a case where the materials of the fastened members 18*a*, 18*b* which are selected by the switch are soft, the reference frequency setter 26 sets a value obtained by subtracting a predetermined offset frequency from the reference frequency which is calculated based on the rotational speed sensor signal as described above, as the reference frequency.

Figure 3:
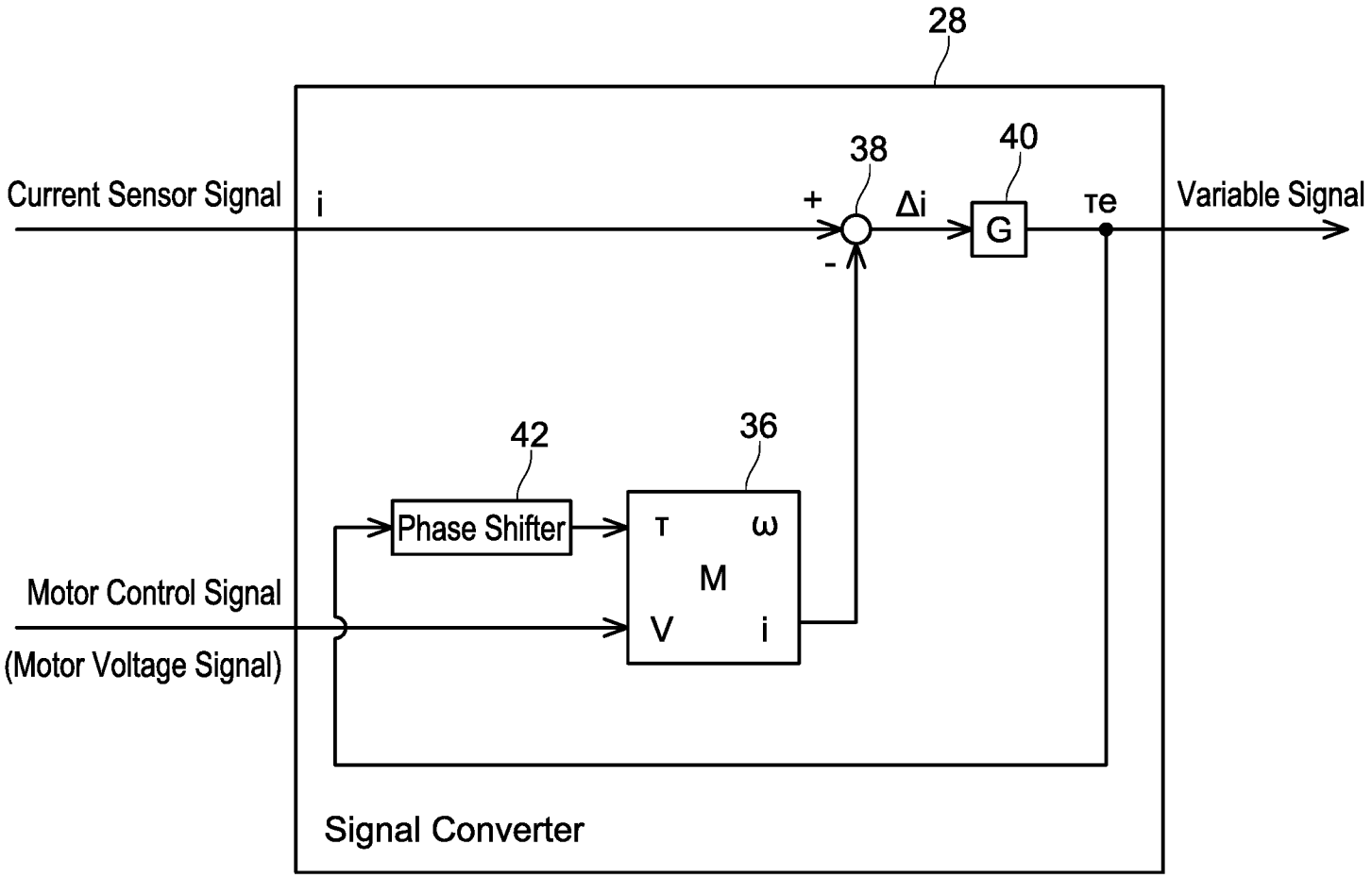
FIG. 3 is a block diagram schematically showing a configuration of a signal converter 28 of the impact fastening tool 2 of the first embodiment.

As shown in FIG. 3, the signal converter 28 obtains a variable signal which varies in accordance with a hit to the anvil 8 by the hammer 6, based on a current sensor signal from the current sensor 24 and a motor control signal from the motor controller 34. The signal converter 28 comprises a motor model 36, a subtractor 38, an amplifier 40, and a phase shifter 42.

The motor model 36 models characteristics of the motor 4 as a transfer function with two inputs and two outputs. In the motor model 36, a voltage V applied to the motor 4 and a torque $\tau$ acting on the motor 4 are the inputs, and a current i flowing through the motor 4 and a rotational speed $\omega$ of the motor 4 are the outputs. For the voltage input of the motor model 36, a motor voltage signal, which is included in the motor control signal from the motor controller 34, is inputted. The motor voltage signal indicates an applied voltage to the motor 4.

The current output of the motor model 36 is supplied to the subtractor 38. In the subtractor 38, a difference $\Delta i$ between an actually measured value of the current in the motor 4 and the current output of the motor model 36 is calculated. The calculated difference is amplified by a predetermined gain G in the amplifier 40, and then is inputted to the phase shifter 42 as an estimated torque $\tau e$ of the motor 4. The phase shifter 42 is a second-order low-pass filter, for example. The phase shifter 42 shifts a phase of the estimated torque $\tau e$ by 90 degrees, and supplies it to the torque input of the motor model 36.

Figure 6A:
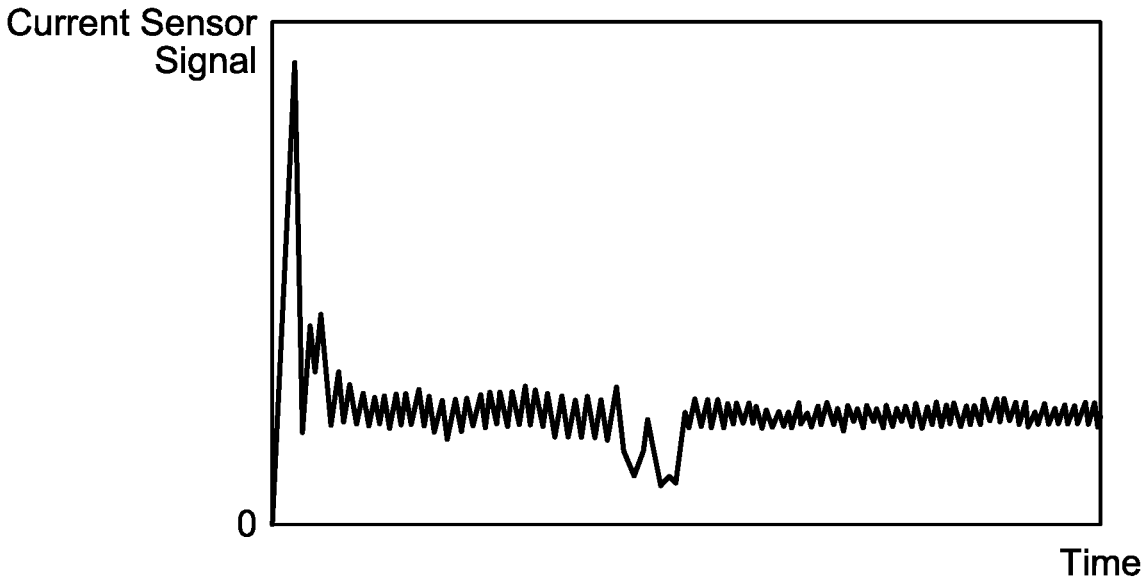
FIG. 6A shows an example of chronological change in a current sensor signal in the impact fastening tool 2 of the first embodiment.
Figure 6B:
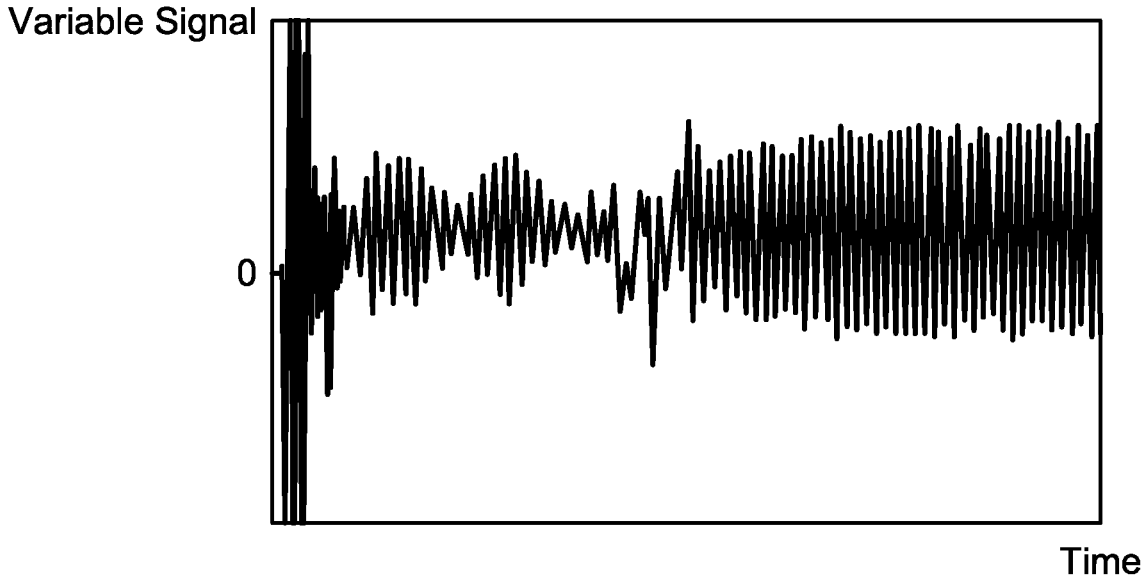
FIG. 6B shows an example of chronological change in a variable signal in the impact fastening tool 2 of the first embodiment.

The signal converter 28 outputs the estimated torque re of the motor 4, which is calculated by the aforementioned feedback group, as the variable signal which varies in accordance with a hit to the anvil 8 by the hammer 6. Due to this, as shown in FIG. 6A and FIG. 6B, the variable signal (shown in FIG. 6B) which varies in accordance with a hit to the anvil 8 by the hammer 6 can be obtained from the current sensor signal (shown in FIG. 6A) from the current sensor 24.

As shown in FIG. 2, the seating determiner 30 comprises a frequency converter 44, a filter 46, an envelope detector 48, a tracking signal generator 50, and a seating determination unit 52.

Figure 4:
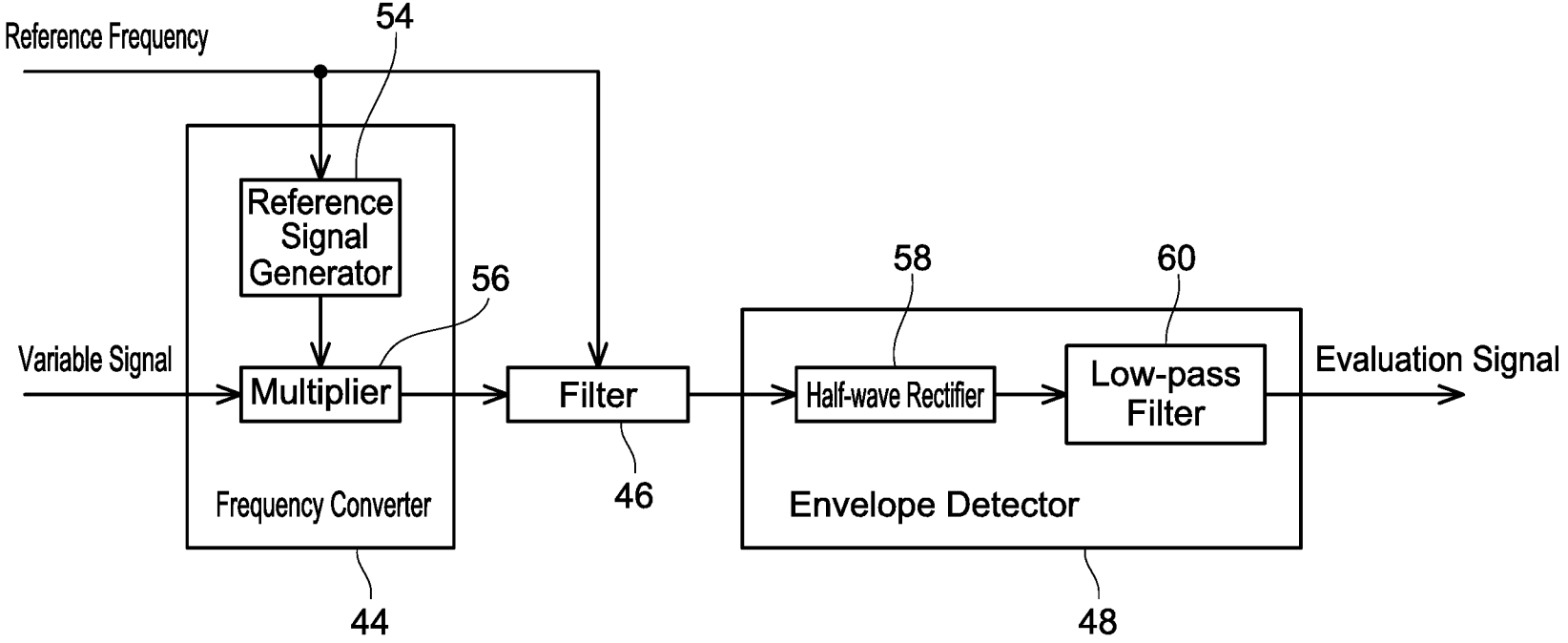
FIG. 4 is a block diagram schematically showing configurations of a frequency converter 44, a filter 46, and an envelope detector 48 of the impact fastening tool 2 of the first embodiment.

As shown in FIG. 4, the frequency converter 44 comprises a reference signal generator 54 and a multiplier 56. The reference signal generator 54 generates a reference signal based on the reference frequency outputted from the reference frequency setter 26. In the present embodiment, the reference signal is a sine-wave signal having a frequency that is twice the reference frequency. It should be noted that the frequency of the reference signal is not limited to the frequency that is twice the reference frequency, and may be any frequency so long as it is equal to or higher than the reference frequency. The multiplier 56 multiplies the variable signal outputted from the signal converter 28 by the reference signal outputted from the reference signal generator 54. The variable signal multiplied by the reference signal is supplied to the filter 46.

The filter 46 filters the variable signal processed by the frequency converter 44 for a frequency band including the reference frequency. The filter 46 is, for example, a bandpass filter, an inverse notch filter, a low-pass filter, or a second-order low-pass filter. A signal component of the variable signal which does not correspond to the reference frequency is suppressed by the process in the filter 46. In the present embodiment, the variable signal is multiplied by the reference signal in the signal converter 28, and thus a signal component included in the variable signal due to influence of galling and the like can be suppressed by using a simple filter.

In the impact fastening tool 2 of the present embodiment, a second-order low-pass filter of which resonance frequency is the reference frequency is used as the filter 46. In this case, the filter 46 can selectively amplify a signal component corresponding to the reference frequency. Due to this, the signal component of the variable signal corresponding to the reference frequency can be accentuated. It should be noted that even in a case where another filter is used as the filter 46, the same effect can be obtained by separately providing a selective amplifier configured to amplify the signal component corresponding to the reference frequency.

Figure 7A:
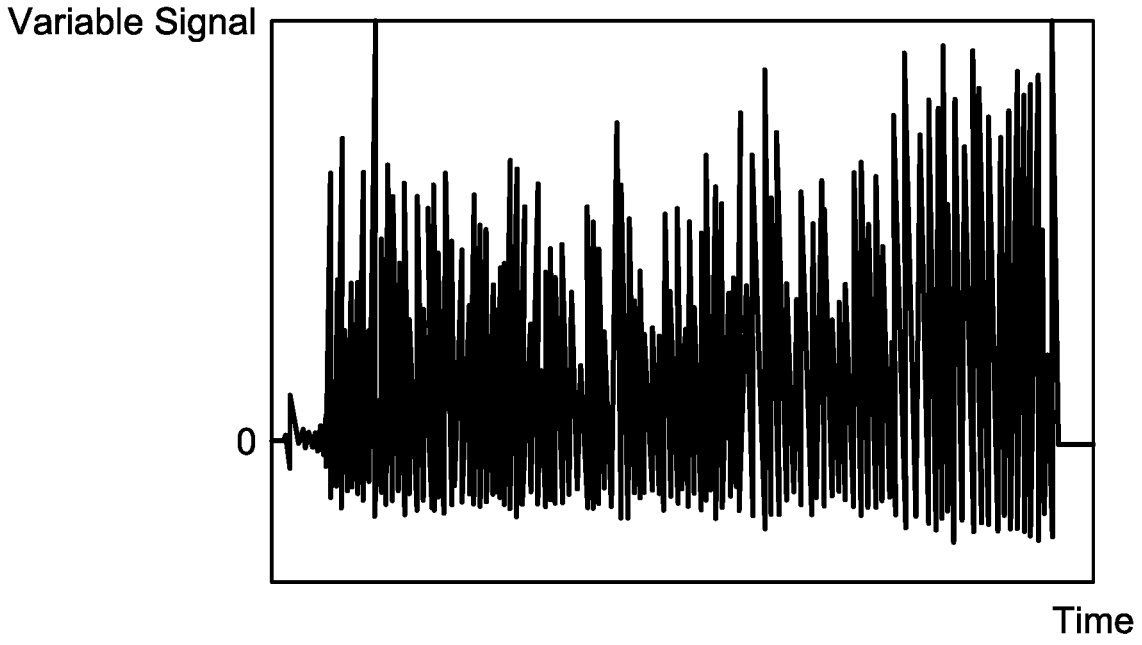
FIG. 7A shows an example of chronological change in the variable signal inputted to a seating determiner 30 in the impact fastening tool 2 of the first embodiment.
Figure 7B:
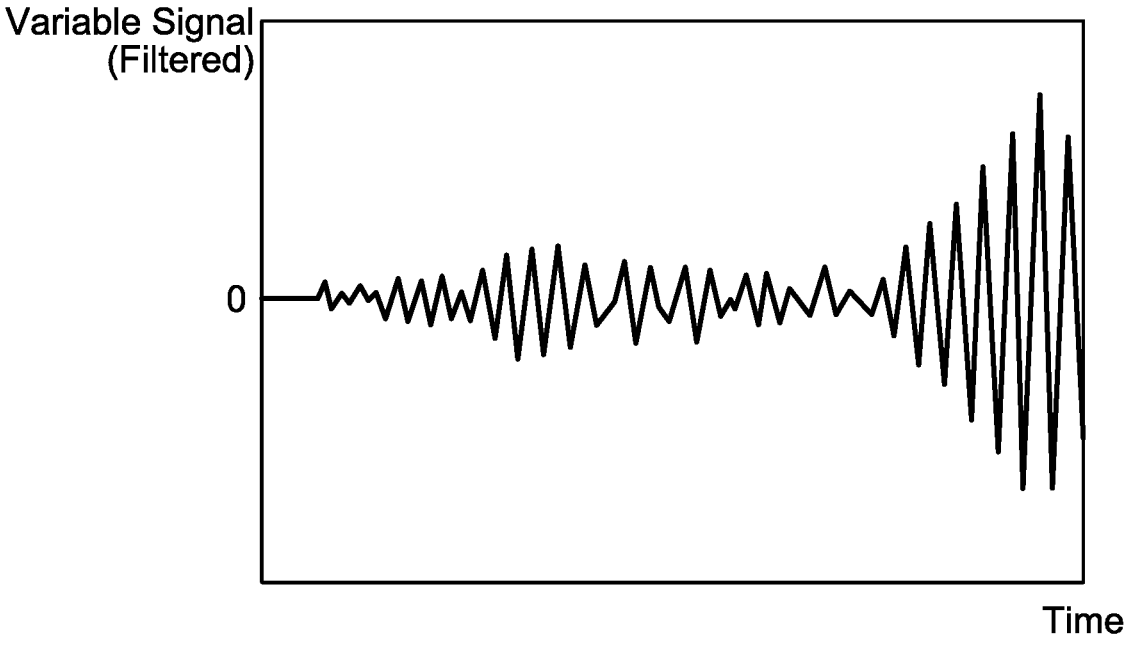
FIG. 7B shows an example of chronological change in the variable signal outputted from the filter 46 in the impact fastening tool 2 of the first embodiment.

As shown in FIG. 7A and FIG. 7B, through the processes in the frequency converter 44 and the filter 46, the variable signal (shown in FIG. 7B) in which its signal component corresponding to the reference frequency has been accentuated and its signal component not corresponding to the reference frequency has been suppressed can be obtained from the variable signal (shown in FIG. 7A) inputted to the seating determiner 30 from the signal converter 28.

The envelope detector 48 shown in FIG. 4 detects an envelope of the variable signal which was processed in the frequency converter 44 and in the filter 46, and outputs the envelope as an evaluation signal. In the impact fastening tool 2 of the present embodiment, the envelope detector 48 comprises a half-wave rectifier 58 and a low-pass filter 60. The half-wave rectifier 58 is, for example, a diode, and the low-pass filter 60 is, for example, a capacitor. The evaluation signal outputted from the envelope detector 48 is inputted to the tracking signal generator 50 and the seating determination unit 52.

Figure 5:
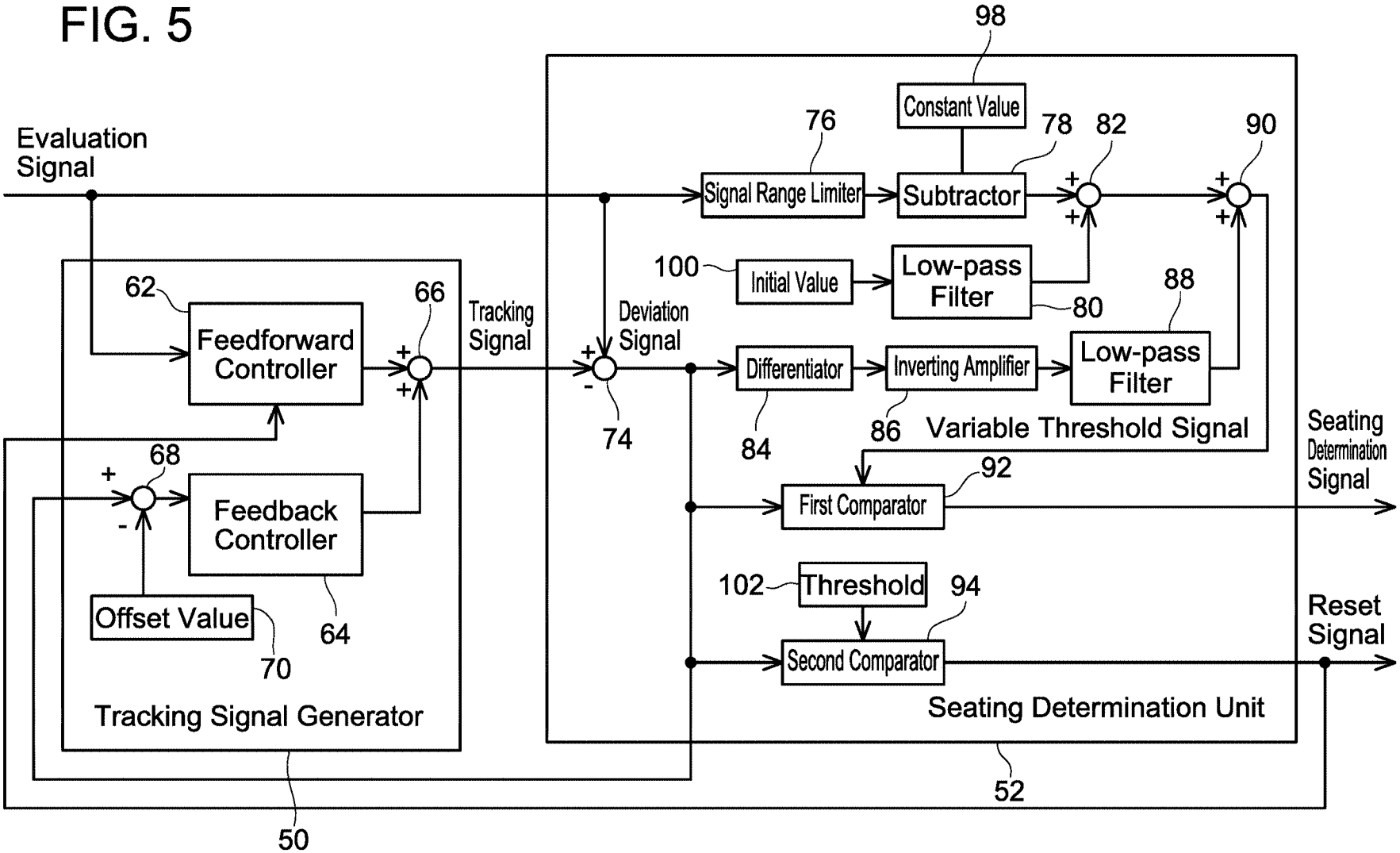
FIG. 5 is a block diagram schematically showing configurations of a tracking signal generator 50 and a seating determination unit 52 of the impact fastening tool 2 of the first embodiment.

As shown in FIG. 5, the tracking signal generator 50 comprises a feedforward controller 62, a feedback controller 64, an adder 66, a subtractor 68, and a resistor 70.

The evaluation signal is inputted to the feedforward controller 62. The feedforward controller 62 outputs a signal that approaches the evaluation signal at a predetermined speed, from an initial value obtained by subtracting a predetermined offset from the evaluation signal. A reset signal is inputted to the feedforward controller 62 from the seating determination unit 52 (to be described later). When the reset signal is inputted, the feedforward controller 62 resets the signal to be outputted therefrom to the initial value. A signal from the subtractor 68 is inputted to the feedback controller 64. The subtractor 68 outputs a signal which is obtained by subtracting an offset value stored in the resistor 70 from a deviation signal which is a deviation between the evaluation signal and a tracking signal. The deviation signal is inputted to the subtractor 68 from the seating determination unit 52 (to be described later). The feedback controller 64 outputs a signal that feeds back the deviation between the evaluation signal and the tracking signal as a proportional gain. The adder 66 adds the output from the feedforward controller 62 to the output from the feedback controller 64, and outputs the result as the tracking signal.

The seating determination unit 52 comprises a subtractor 74, an signal range limiter 76, a divider 78, a low-pass filter 80, an adder 82, a differentiator 84, an inverting amplifier 86, a low-pass filter 88, an adder 90, a first comparator 92, a second comparator 94, a resistor 98, a resistor 100, and a resistor 102.

The subtractor 74 subtracts the tracking signal inputted from the tracking signal generator 50 from the evaluation signal inputted from the envelope detector 48, and outputs the result as the deviation signal. As aforementioned, the deviation signal outputted from the subtractor 74 is inputted to the subtractor 68 of the tracking signal generator 50. Further, the deviation signal outputted from the subtractor 74 is also inputted to the first comparator 92 and the second comparator 94.

The second comparator 94 compares the deviation signal inputted from the subtractor 74 with a predetermined threshold stored in the resistor 102, tentatively determines that the fastener 16 has been seated when a deviation between the evaluation signal and the tracking signal becomes equal to or less than the threshold, and outputs the reset signal. In the impact fastening tool 2 of the present embodiment, the threshold stored in the resistor 102 is zero. In this case, the second comparator 94 tentatively determines that the fastener 16 has been seated each time the tracking signal reaches the evaluation signal, and outputs the reset signal. As aforementioned, the reset signal outputted from the second comparator 94 is inputted to the feedforward controller 62 of the tracking signal generator 50. Further, the reset signal outputted from the second comparator 94 is also inputted to the motor stopper 32 (to be described later).

Figure 8:
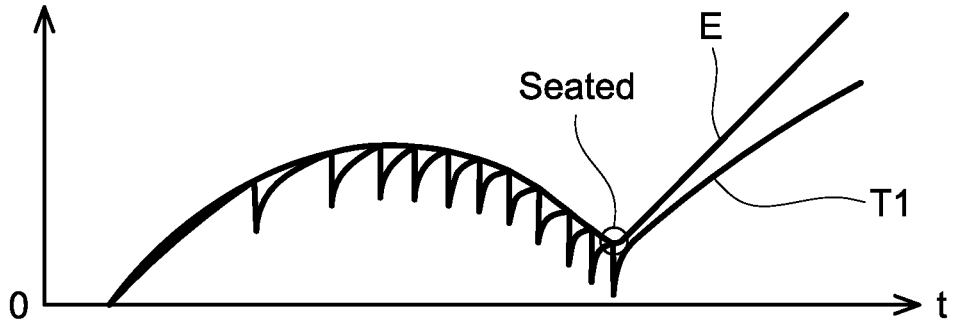
FIG. 8 shows an example of chronological changes in an evaluation signal E and a tracking signal T1 in the impact fastening tool 2 of the first embodiment.

FIG. 8 shows an example of chronological changes in an evaluation signal E outputted from the envelope detector 48 and in a tracking signal T1 generated in the tracking signal generator 50 based on the evaluation signal E. A magnitude of the evaluation signal E outputted from the envelope detector 48 indicates a magnitude of the signal component corresponding to the reference frequency in the variable signal. As shown in FIG. 8, before the fastener 16 is seated, the evaluation signal E varies due to influence of galling and the like, but it does not increase continuously. Then, after the fastener 16 has been seated, the evaluation signal E increases continuously with a predetermined slope. This is because the signal component corresponding to the reference frequency increases in the variable signal after the fastener 16 has been seated, whereas the signal component corresponding to the reference frequency is barely included in the variable signal before the fastener 16 is seated.

Contrary to such behavior of the evaluation signal E, before the fastener 16 is seated, the tracking signal T1 repeats a motion of frequently reaching the evaluation signal E and being reset each time of the reaching. Then, after the fastener 16 has been seated, the tracking signal T1 becomes incapable of reaching the evaluation signal E, and continuously increases with a smaller slope than that of the evaluation signal E, without being reset.

Focusing on such behaviors of the evaluation signal E and the tracking signal T1, the seating determination unit 52 tentatively determines that the fastener 16 has been seated and resets the tracking signal T1 each time the tracking signal T1 reaches the evaluation signal E, Thereafter, when a determination criterion by the first comparator 92 (to be described later) is satisfied without the tracking signal T1 reaching the evaluation signal F, the seating determination unit 52 conclusively determines that the fastener 16 was seated at a time when it was tentatively determined that the fastener 16 had been seated the last time. Hereinbelow, generation of a variable threshold signal which is used for a determination in the first comparator 92 will be described.

The signal range limiter 76 outputs the evaluation signal as it is, in a case where the evaluation signal is between a predetermined upper limit value and a lower limit value; outputs the upper limit value instead of the evaluation signal in a ease where the evaluation signal exceeds the upper limit value; and outputs the lower limit value instead of the evaluation signal, in a case where the evaluation signal is below the lower limit value. The divider 78 outputs a value obtained by dividing a constant value stored in the resistor 98 by the output of the signal range limiter 76. Due to this, a signal corresponding to a reciprocal of the evaluation signal is outputted from the divider 78.

The low-pass filter 80 outputs a signal that attenuates with a predetermined time constant from an initial value stored in the resistor 100. The signal outputted from the low-pass filter 30 is added to the signal outputted from the divider 78, by the adder 82.

The differentiator 84 outputs a signal obtained by differentiating the deviation between the evaluation signal and the tracking signal with respect to time. The inverting amplifier 86 inverts a sign of the signal outputted from the differentiator 84. The low-pass filter 88 outputs a signal obtained by attenuating the signal outputted from the inverting amplifier 86 with a predetermined time constant. The signal outputted from the low-pass filter 88 is added to the signal outputted from the adder 82, by the adder 90. The adder 90 outputs, as a variable threshold signal, a signal that totals the signal outputted from the divider 78, the signal outputted from the low-pass filter 80, and the signal outputted from the low-pass filter 38.

The variable threshold signal generated as above has a large value when the evaluation signal is small, immediately after a start of hitting, and at the time of the reset operation, and thus using this variable threshold signal for seating determination can make it less likely to determine that the fastener 16 has been seated under the above situations. Due to this, whether the fastener 16 has been seated or not can be determined more accurately.

The first comparator 92 compares the deviation signal inputted from the subtractor 74 with the variable threshold signal outputted from the adder 90, determines that the fastener 16 has been seated in a case where a difference between those signals reaches a predetermined value, and then outputs a seating determination signal.

Figure 9:
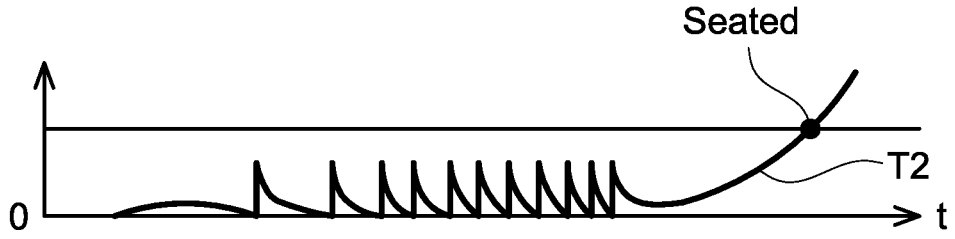
FIG. 9 shows an example of chronological change in a signal T2 which indicates a difference between a deviation signal and a variable threshold signal in the impact fastening tool 2 of the first embodiment.

FIG. 9 shows a situation where the first comparator 92 outputs the seating determination signal. In FIG. 9, a signal T2 indicates a signal obtained by subtracting the variable threshold signal outputted from the adder 90 from the deviation signal inputted from the subtractor 74. The first comparator 92 outputs the seating determination signal, in a case where this signal T2 reaches the predetermined value.

As aforementioned, in the seating determination unit 52, it is tentatively determined that the fastener 16 has been seated each time the reset signal is outputted from the second comparator 94, and thereafter, when the determination criterion is satisfied in the first comparator 92, it is conclusively determined that the fastener 16 was seated at the last time it was tentatively determined that the fastener 16 had been seated. Due to such a configuration, whether the fastener 16 has been seated or not can be determined accurately.

Figure 23:
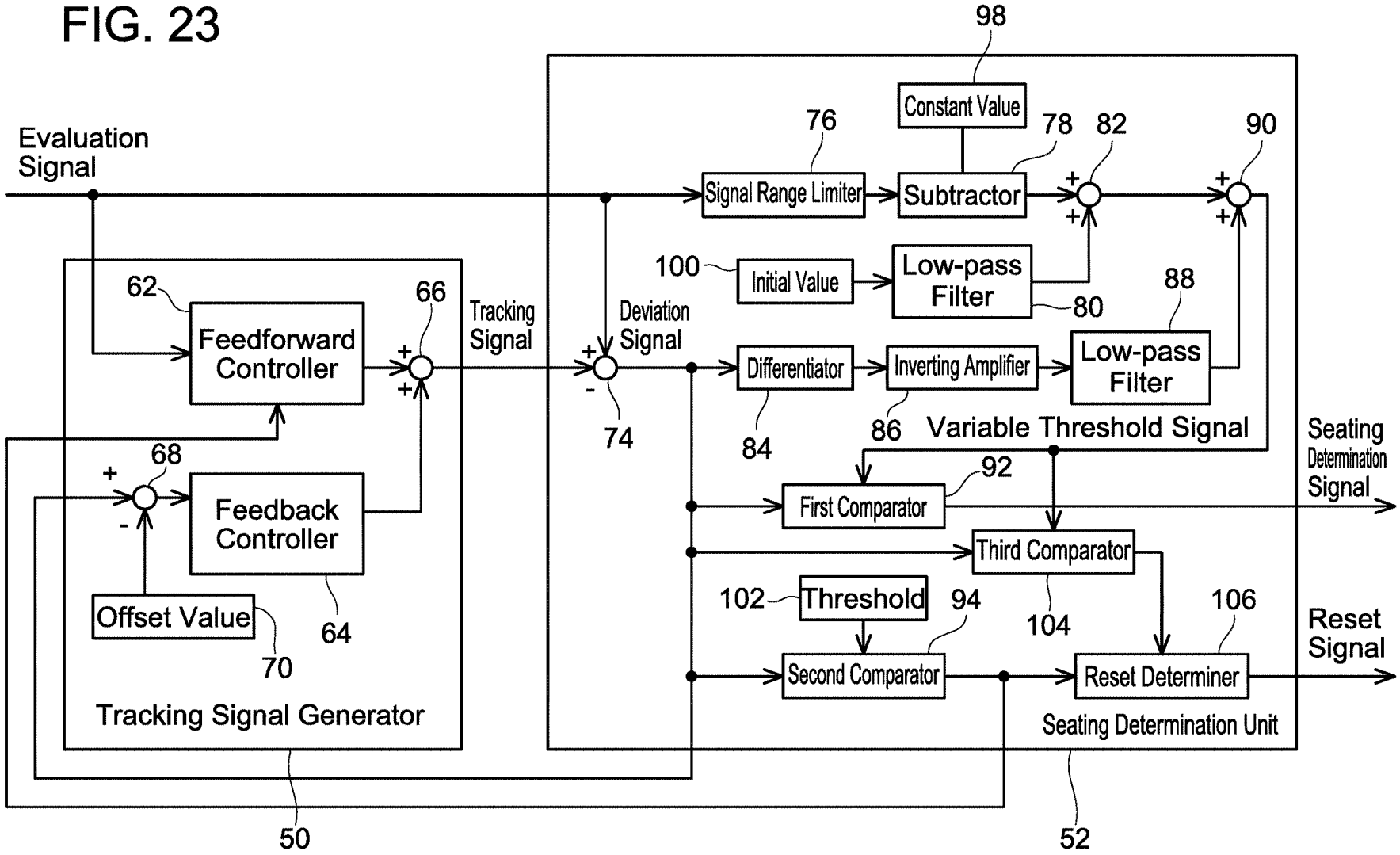
FIG. 23 is a block diagram schematically showing a configuration of a variant of the seating determination unit 52 of the impact fastening tool 2 of the first embodiment.

It should be noted that as shown in FIG. 23, the seating determination unit 52 may further comprise a third comparator 104 and a reset determiner 106. The third comparator 104 outputs the reset signal, in a case where the deviation signal becomes equal to or less than the variable threshold signal. The reset determiner 106 tentatively determines that the fastener 16 has been seated, not only in the case where the reset signal is outputted from the second comparator 94 (i.e., in the case where the deviation signal becomes equal to or less than the threshold), but also in a case where the reset signal is outputted from the third comparator 104 (i.e., in the case where the deviation signal becomes equal to or less than the variable threshold signal), and outputs the reset signal to the motor stopper 32 (to be described later). Due to such a configuration, even in a case where the evaluation signal does not vary despite galling occurring and a time period during which the deviation signal does not become equal to or less than the threshold thereby lasts, the reset signal can be outputted to the motor stopper 32 at the time when the deviation signal becomes equal to or less than the variable threshold signal. Due to this, a stop determination for the motor 4 can be performed more accurately in the motor stopper 32.

As shown in FIG. 2, the motor stopper 32 comprises a counter 108 and a stop determiner 110.

The counter 108 detects hits to the anvil 8 by the hammer 6 based on the variable signal, and counts hitting time. In the present embodiment, the counter 108 detects a hit to the anvil 8 by the hammer 6 by detecting a leading edge of the variable signal. When the hammer 6 starts to hit the anvil 8, the counter 108 starts to count the hitting time. The counter 108 resets the hitting time which is being counted each time the reset signal is inputted from the seating determination unit 52. When the hitting time which is being counted reaches a predetermined time length, the counter 108 outputs a stop determination signal. That is, the counter 108 uses the hitting time as a stop determination value, and outputs the stop determination signal when the stop determination value reaches a predetermined value.

The stop determiner 110 outputs a motor stop signal, in a case where the seating determination signal is outputted from the seating determination unit 52 and the stop determination signal is outputted from the counter 108.

The motor controller 34 outputs a motor control signal to the motor driver 20. When the motor stop signal is inputted from the motor stopper 32, the motor controller 34 outputs the motor control signal for stopping the motor 4 to the motor driver 20.

According to the above-described impact fastening tool 2, the motor 4 can be stopped when the hitting time, which has lapsed since it was determined that the fastener 16 had been seated, reaches the predetermined time. Due to such a configuration, the hitting time after the fastener 16 has been seated can be managed accurately.

It should be noted that in the above-described embodiment, the counter 108 may count a number of hits to the anvil by the hammer 6, instead of counting the hitting time during which the hammer 6 hits the anvil 8. In this case as well, the counter 108 resets the number of hits which is being counted each time the reset signal is inputted from the seating determination unit 52. When the number of hits which is being counted reaches a predetermined number, the counter 108 outputs the stop determination signal. That is, the counter 108 uses the number of hits as the stop determination value, and outputs the stop determination signal when the stop determination value reaches the predetermined value. In a case of such a configuration, the impact fastening tool 2 can stop the motor 4 when the number of hits, which has been counted since it was determined that the fastener 16 had been seated, reaches the predetermined number. Due to such a configuration, the number of hits after the fastener 16 has been seated can be managed accurately.

Figure 10:
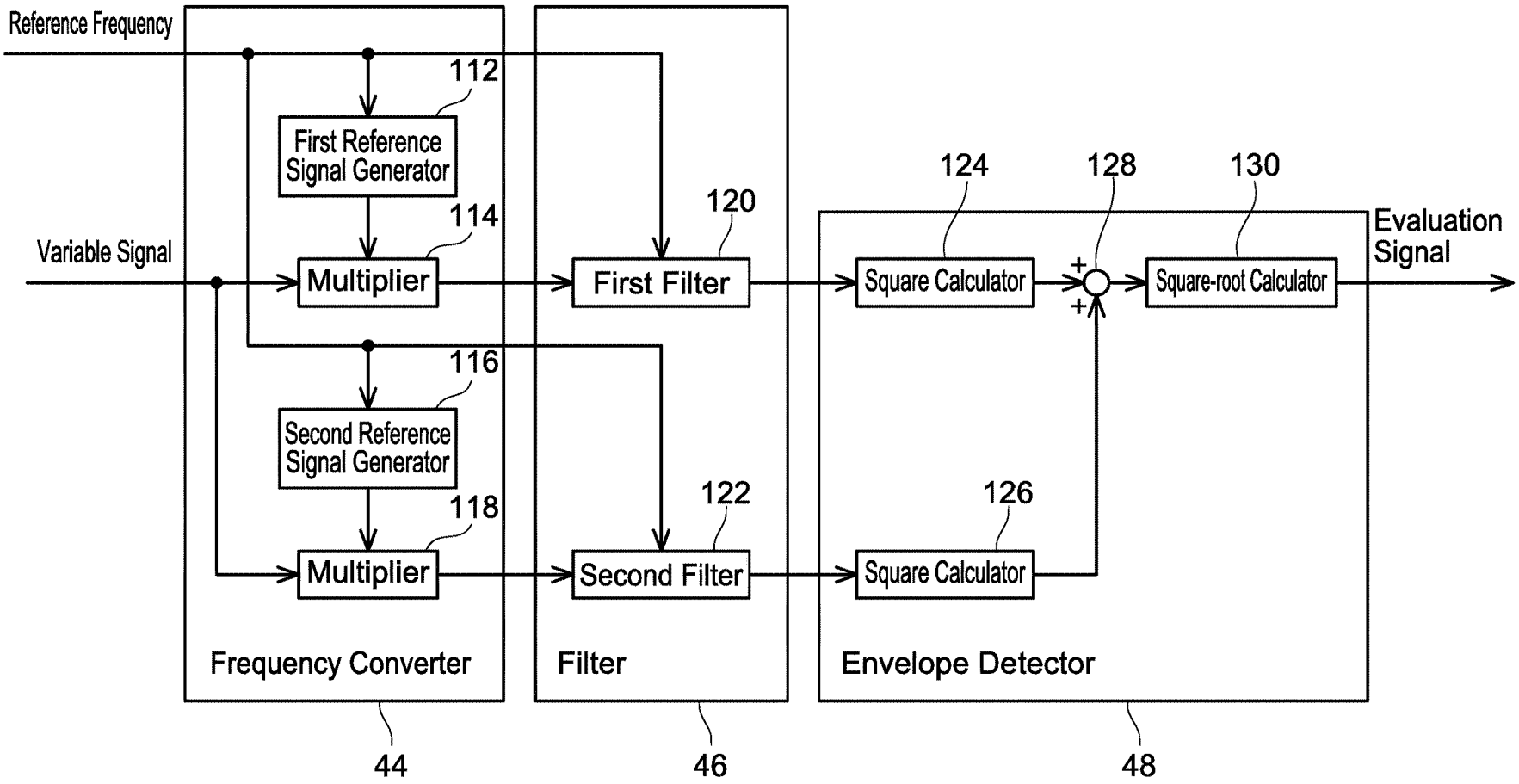
FIG. 10 is a block diagram schematically showing other configurations of the frequency converter 44, the filter 46, and the envelope detector 48 of the impact fastening tool 2 of the first embodiment.

In the above-described embodiment, instead of the configuration shown in FIG. 4 for the frequency converter 44, the filter 46, and the envelope detector 48, a configuration shown in FIG. 10 may be adopted.

In the configuration shown in FIG. 10, the frequency converter 44 comprises a first reference signal generator 112, a multiplier 114, a second reference signal generator 116, and a multiplier 118. The filter 46 comprises a first filter 120 and a second filter 122. The envelope detector 48 comprises a square calculator 124, a square calculator 126, an adder 128, and a square-root calculator 130.

The first reference signal generator 112 of the frequency converter 44 generates a first reference signal based on the reference frequency outputted from the reference frequency setter 26. In the present embodiment, the first reference signal is a sine-wave signal having a frequency which is twice the reference frequency. The multiplier 114 multiplies the variable signal outputted from the signal converter 28 by the first reference signal outputted from the first reference signal generator 112. The variable signal multiplied by the first reference signal is supplied to the first filter 120 of the filter 46.

The second reference signal generator 116 of the frequency converter 44 generates a second reference signal based on the reference frequency outputted from the reference frequency setter 26. The second reference signal is a signal which has the same frequency as that of the first reference signal and has a phase shifted by 90 degrees with respect to a phase of the first reference signal. In the present embodiment, the second reference signal is a cosine-wave signal having a frequency which is twice the reference frequency. The multiplier 118 multiplies the variable signal outputted from the signal converter 28 by the second reference signal outputted from the second reference signal generator 116. The variable signal multiplied by the second reference signal is supplied to the second filter 122 of the filter 46. It should be noted that the frequencies of the first reference signal and the second reference signal are not limited to the frequency which is twice the reference frequency, and may be any frequency so long as it is equal to or higher than the reference frequency.

The first filter 120 of the filter 46 filters the signal outputted from the multiplier 114 for a frequency band including the reference frequency. The first filter 120 is, for example, a bandpass filter, an inverse notch filter, a low-pass filter, and a second-order low-pass filter. In the impact fastening tool 2 of the present embodiment, a second-order low-pass filter of which resonance frequency is the reference frequency is used as the first filter 120. A signal outputted from the first filter 120 is supplied to the square calculator 124 of the envelope detector 48.

The second filter 122 of the filter 46 filters the signal outputted from the multiplier 118 for a frequency band including the reference frequency. The second filter 122 is, for example, a bandpass filter, an inverse notch filter, a low-pass filter, and a second-order low-pass filter. In the impact fastening tool 2 of the present embodiment, a second-order low-pass filter of which resonance frequency is the reference frequency is used as the second filter 122. Especially, in the impact fastening tool 2 of the present embodiment, the second filter 122 is a filter having characteristics same as those of the first filter 120. A signal outputted from the second filter 122 is supplied to the square calculator 126 of the envelope detector 48.

The square calculator 124 of the envelope detector 48 calculates a square of the signal outputted from the first filter 120, and outputs it to the adder 128. Similarly, the square calculator 126 calculates a square of the signal outputted from the second filter 122, and outputs it to the adder 128. The adder 128 calculates a sum of the signal outputted from the square calculator 124 and the signal outputted from the square calculator 126, and outputs it to the square-root calculator 130. The square-root calculator 130 calculates a square root of the signal outputted from the adder 128, and outputs it as the evaluation signal.

Through the processes of the frequency converter 44, the filter 46, and the envelope detector 48 shown in FIG. 10 as well, the evaluation signal, which is the envelope of the signal component corresponding to the reference frequency, can be obtained from the variable signal outputted from the signal converter 28.

Second Embodiment

Figure 11:
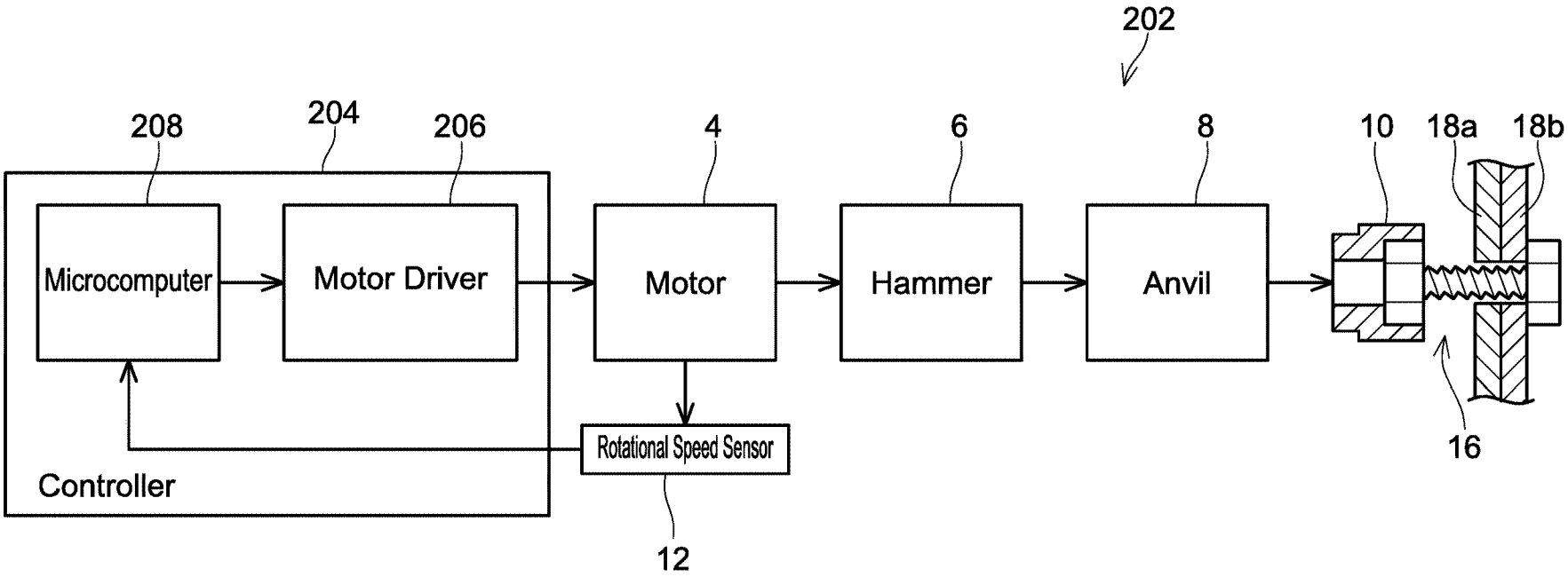
FIG. 11 is a block diagram schematically showing a configuration of an impact fastening tool 202 of a second embodiment.

FIG. 11 schematically shows a configuration of an impact fastening tool 202 of an embodiment. The impact fastening tool 202 of the present embodiment comprises almost the same configuration as that of the impact fastening tool 2 of the first embodiment. Hereinbelow, differences of the impact fastening tool 202 of the present embodiment from the impact fastening tool 2 of the first embodiment will be described in detail.

The impact fastening tool 202 of the present embodiment comprises the motor 4, the hammer 6, the anvil 8, the bit 10, the rotational speed sensor 12, and a controller 204. The motor 4, the hammer 6, the anvil 8, the bit 10, and the rotational speed sensor 12 are the same as those of the impact fastening tool 2 of the first embodiment. The controller 204 comprises a motor driver 206 and a microcomputer 208. The motor driver 206 does not comprise a current sensor.

Figure 12:
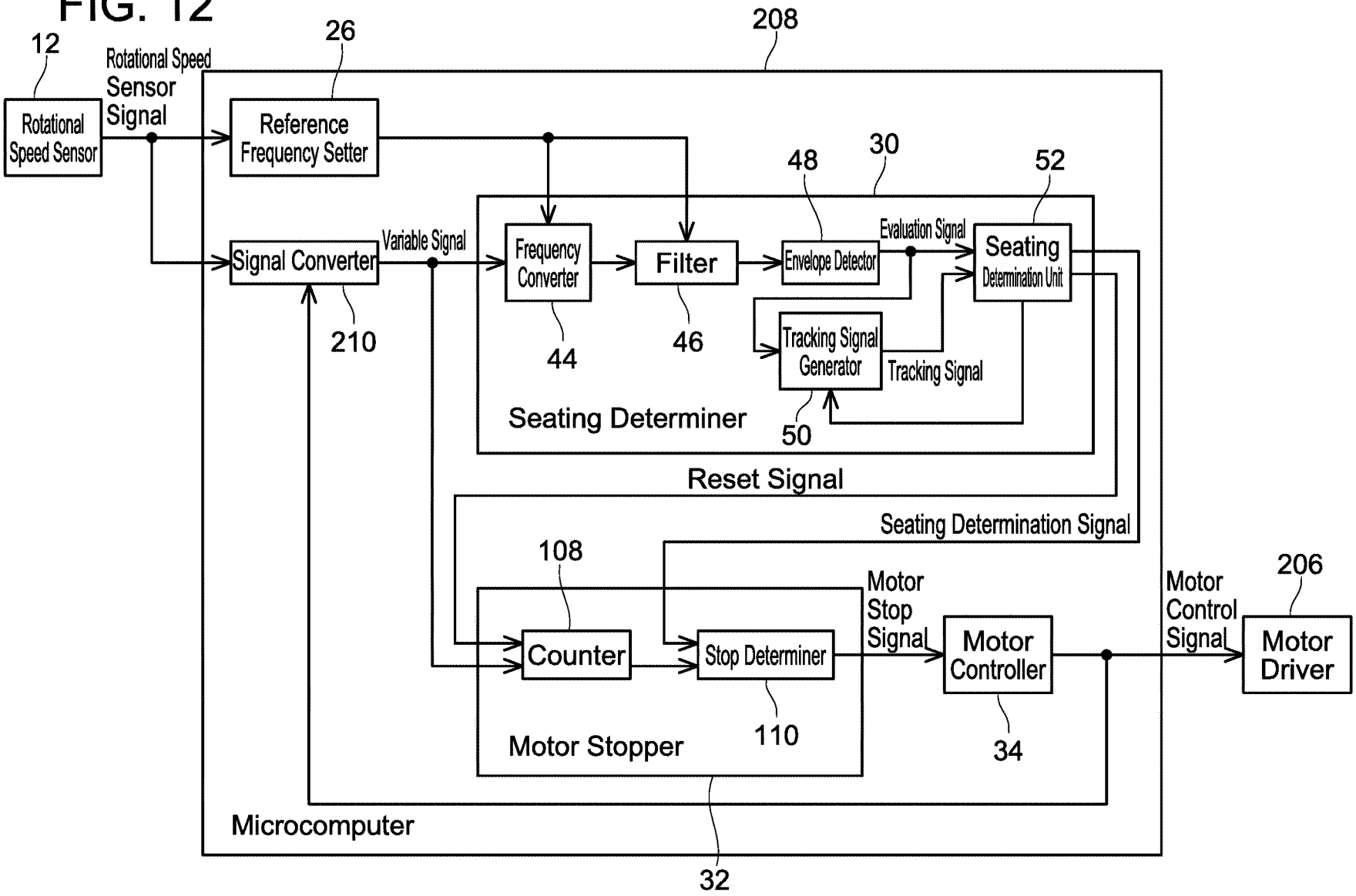
FIG. 12 is a block diagram schematically showing a configuration of a microcomputer 208 of the impact fastening tool 202 of the second embodiment.

As shown in FIG. 12, the microcomputer 208 comprises the reference frequency setter 26, a signal converter 210, the seating determiner 30, the motor stopper 32, and the motor controller 34. The microcomputer 208 can be implemented as a processes which comprises hardware, software, or a combination of hardware and software for realizing functions of the above-mentioned units. The reference frequency setter 26, the seating determiner 30, the motor stopper 32, and the motor controller 34 are the same as those of the impact fastening tool 2 of the first embodiment.

Figure 13:
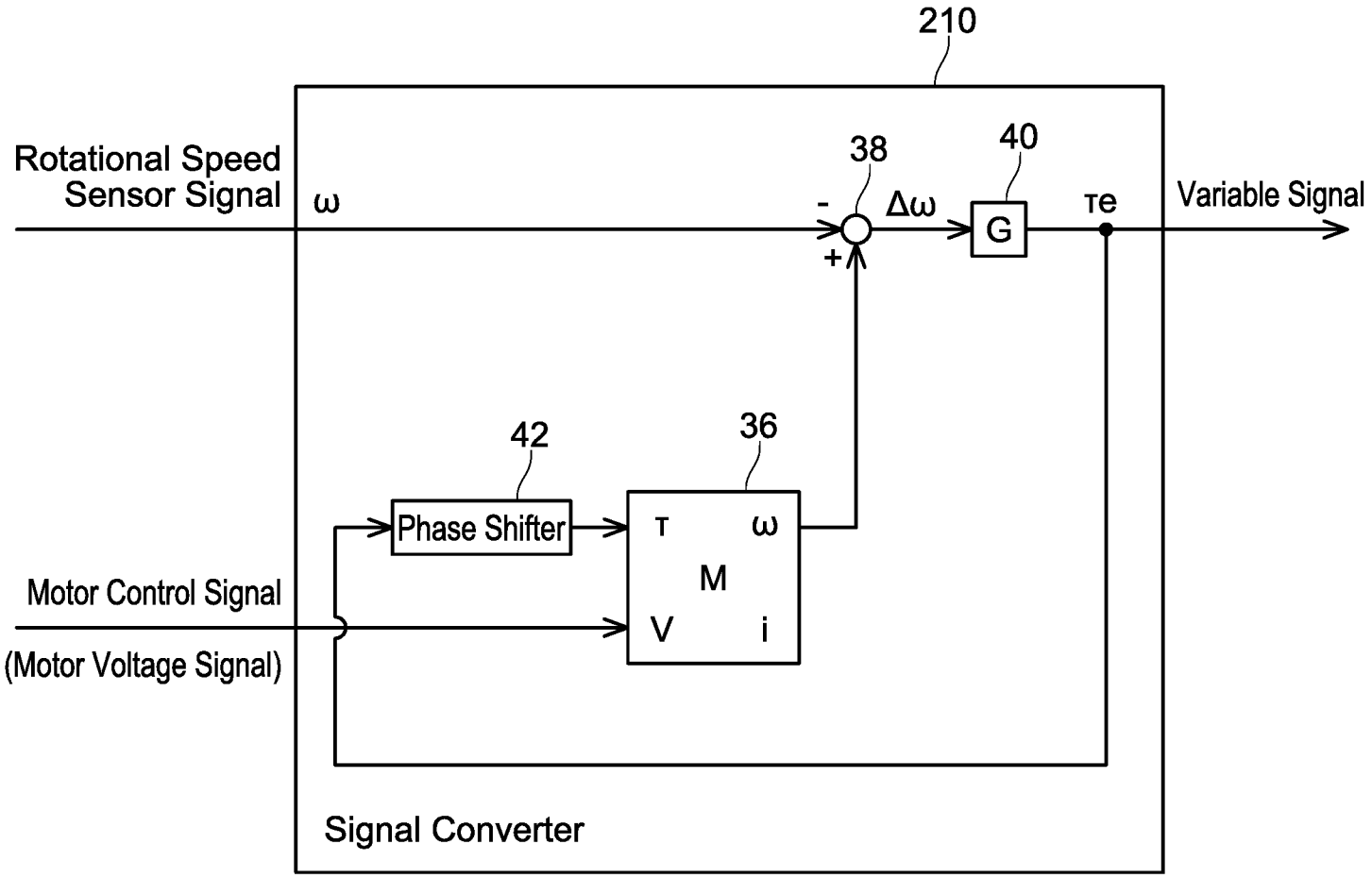
FIG. 13 is a block diagram schematically showing a configuration of a signal converter 210 of the impact fastening tool 202 of the second embodiment.

As shown in FIG. 13, the signal converter 210 obtains a variable signal which varies in accordance with a hit to the anvil 8 by the hammer 6, based on a rotational speed sensor signal from the rotational speed sensor 12 and a motor control signal from the motor controller 34. The signal converter 210 comprises the motor model 36, the subtractor 38, the amplifier 40, and the phase shifter 42. The motor model 36, the subtractor 38, the amplifier 40, and the phase shifter 42 are the same as those of the impact fastening tool 2 of the first embodiment, however, in the impact fastening tool 202 of the present embodiment, the subtractor 38 calculates a difference $\Delta\omega$ between an actually measured value of rotational speed of the motor 4 and a rotational speed output of the motor model 36. The calculated difference is amplified by the predetermined gain G in the amplifier 40, and then is inputted to the phase shifter 42 as an estimated torque re of the motor 4. The signal converter 210 outputs the estimated torque re of the motor 4, which is calculated by the above feedback group, as the variable signal which varies in accordance with a hit to the anvil 8 by the hammer 6.

According to the impact fastening tool 202 of the present embodiment, the variable signal can be obtained without using a current sensor configured to detect a current flowing through the motor 4, and whether the fastener 16 has been seated or not can be determined based on that variable signal.

Third Embodiment

Figure 14:
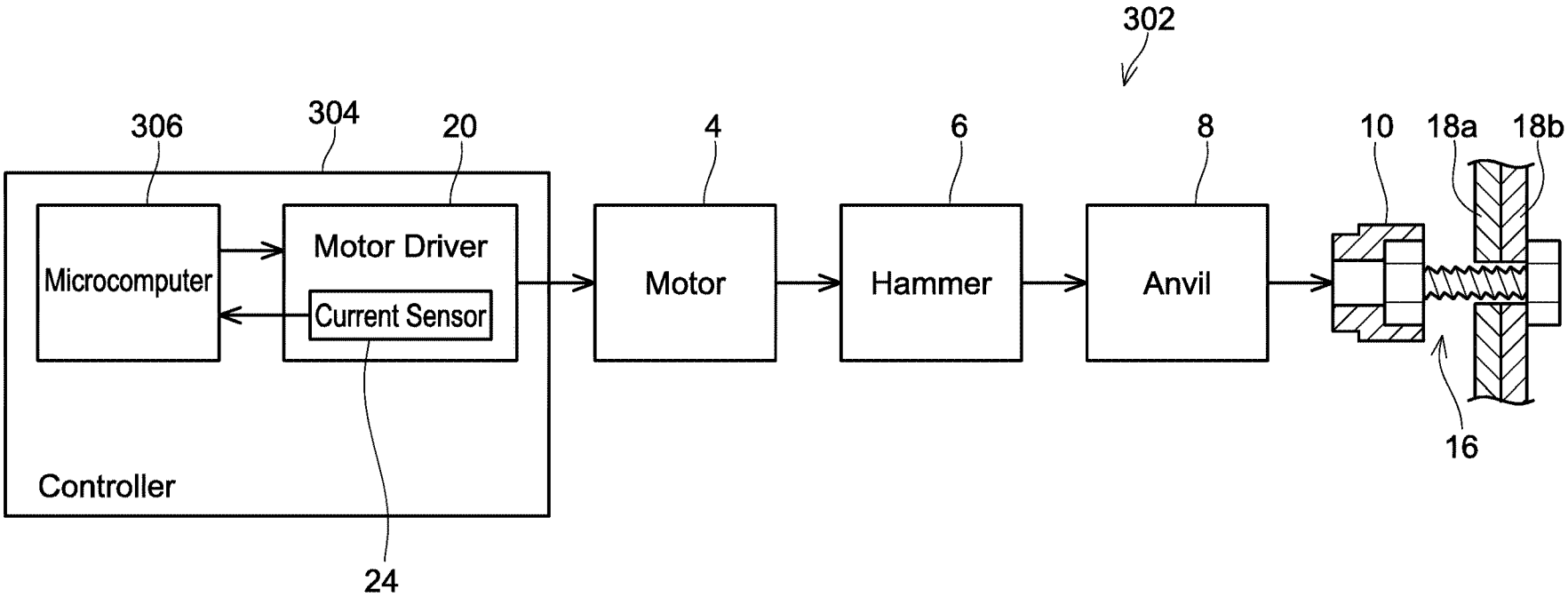
FIG. 14 is a block diagram schematically showing a configuration of an impact fastening tool 302 of a third embodiment.

FIG. 14 schematically shows a configuration of an impact fastening tool 302 of an embodiment. The impact fastening tool 302 of the present embodiment comprises almost the same configuration as that of the impact fastening tool 2 of the first embodiment. Hereinbelow, differences of the impact fastening tool 302 of the present embodiment from the impact fastening tool 2 of the first embodiment will be described in detail.

The impact fastening tool 302 of the present embodiment comprises the motor 4, the hammer 6, the anvil 8, the bit 10, and a controller 304. The motor 4, the hammer 6, the anvil 8, and the bit 10 are the same as those of the impact fastening tool 2 of the first embodiment. The impact fastening tool 302 of the present embodiment does not comprise a rotational speed sensor configured to detect a rotational speed of the motor 4. The controller 304 comprises the motor driver 20 and a microcomputer 306. The motor driver 20 comprises the current sensor 24.

Figure 15:
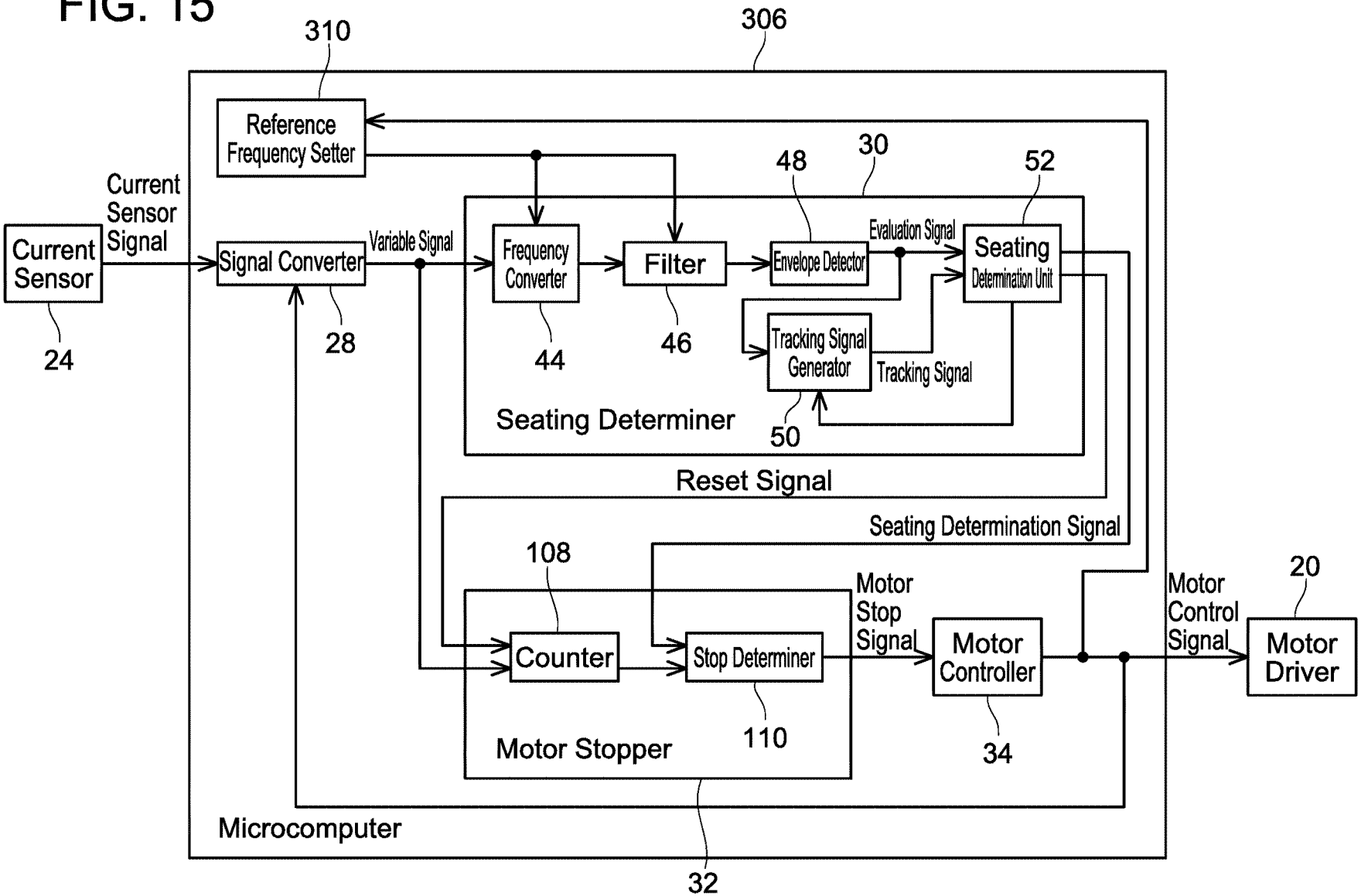
FIG. 15 is a block diagram schematically showing a configuration of a microcomputer 306 of the impact fastening tool 302 of the third embodiment.

As shown in FIG. 15, the microcomputer 306 comprises a reference frequency setter 310, the signal converter 28, the seating determiner 30, the motor stopper 32, and the motor controller 34. The microcomputer 306 can be implemented as a processes which comprises hardware, software, or a combination of hardware and software for realizing functions of the above-mentioned units. The signal converter 28, the seating determiner 30, the motor stopper 32, and the motor controller 34 are the same as those of the impact fastening tool 2 of the first embodiment.

The reference frequency setter 310 sets a reference frequency based on a motor control signal from the motor controller 34. In the impact fastening tool 302 of the present embodiment, the reference frequency setter 310 obtains a target rotational speed of the motor 4 which is included in the motor control signal, and calculates a target rotational speed of the hammer 6 from the target rotational speed of the motor 4. Then, the reference frequency setter 310 outputs, as the reference frequency, a frequency which is twice the target rotational speed of the hammer 6.

The impact fastening tool 302 may comprise a switch (not shown) by which, a user can select materials of the fastened members 18*a*, 18*b*. In this case, in a case where the materials of the fastened members 18*a*, 18*b* which are selected by the switch are hard, the reference frequency setter 310 uses the reference frequency calculated based on the target rotational speed of the motor 4 as it is. In a case where the materials of the fastened members 18*a*, 18*b* which are selected by the switch are soft, the reference frequency setter 310 sets a value obtained by subtracting a predetermined offset frequency from the reference frequency calculated based on the target rotational speed of the motor 4, as a reference frequency.

According to the impact fastening tool 302 of the present embodiment, the reference frequency can be set without using a rotational speed sensor configured to detect a rotational speed of the motor 4, and whether the fastener 16 has been seated or not can be determined based on that reference frequency.

Fourth Embodiment

Figure 16:
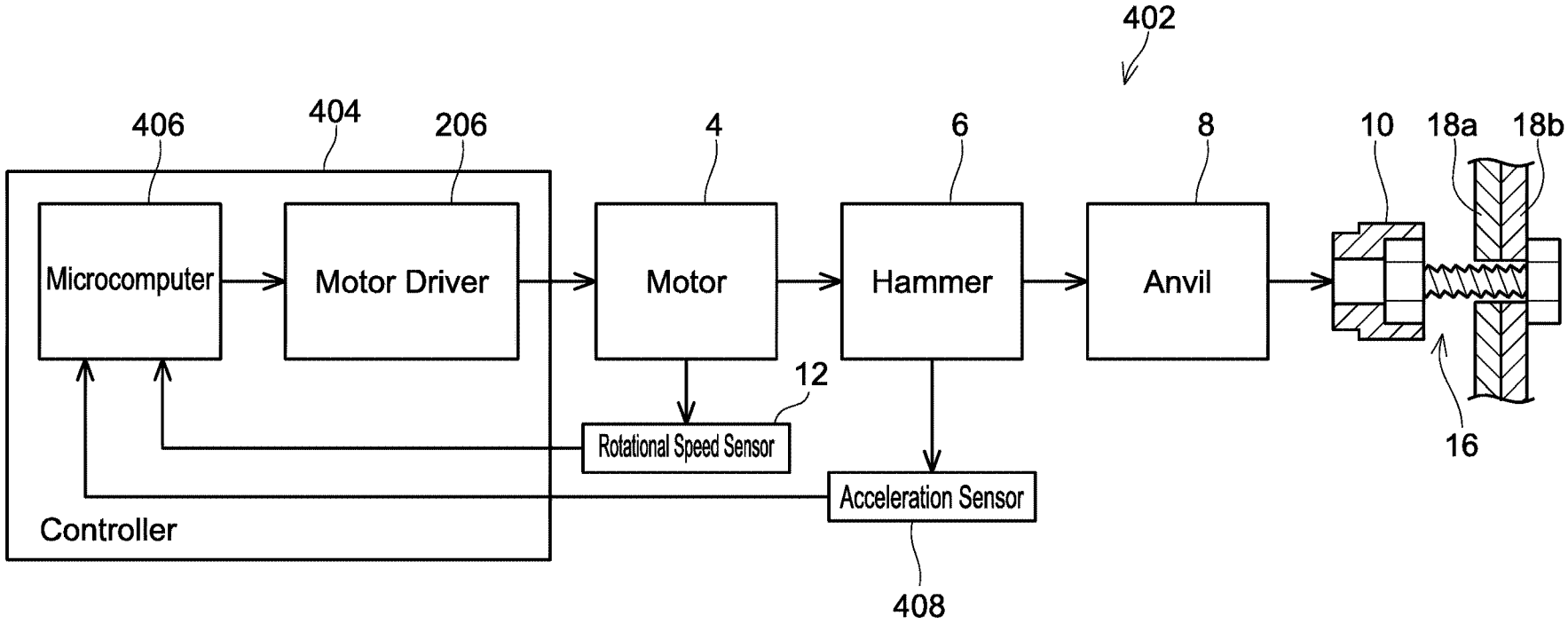
FIG. 16 is a block diagram schematically showing a configuration of an impact fastening tool 402 of a fourth embodiment.

FIG. 16 schematically shows a configuration of an impact fastening tool 402 of an embodiment. The impact fastening tool 402 of the present embodiment comprises almost the same configuration as those of the impact fastening tool 2 of the first embodiment and the impact fastening tool 202 of the second embodiment. Hereinbelow, differences of the impact fastening tool 402 of the present embodiment from the impact fastening tool 2 of the first embodiment and the impact fastening tool 202 of the second embodiment will be described in detail.

The impact fastening tool 402 of the present embodiment comprises the motor 4, the hammer 6, the anvil 8, the bit 10, the rotational speed sensor 12, and a controller 404. The motor 4, the hammer 6, the anvil 8, the bit 10, and the rotational speed sensor 12 are the same as those of the impact fastening tool 2 of the first embodiment. The impact fastening tool 402 of the present embodiment further comprises an acceleration sensor 408 which is provided at the hammer 6 and is configured to detect impact generated when the hammer 6 hits the anvil 8. The controller 404 comprises the motor driver 206 and a microcomputer 406. The motor driver 206 does not comprise a current sensor as in the impact fastening tool 202 of the second embodiment.

Figure 17:
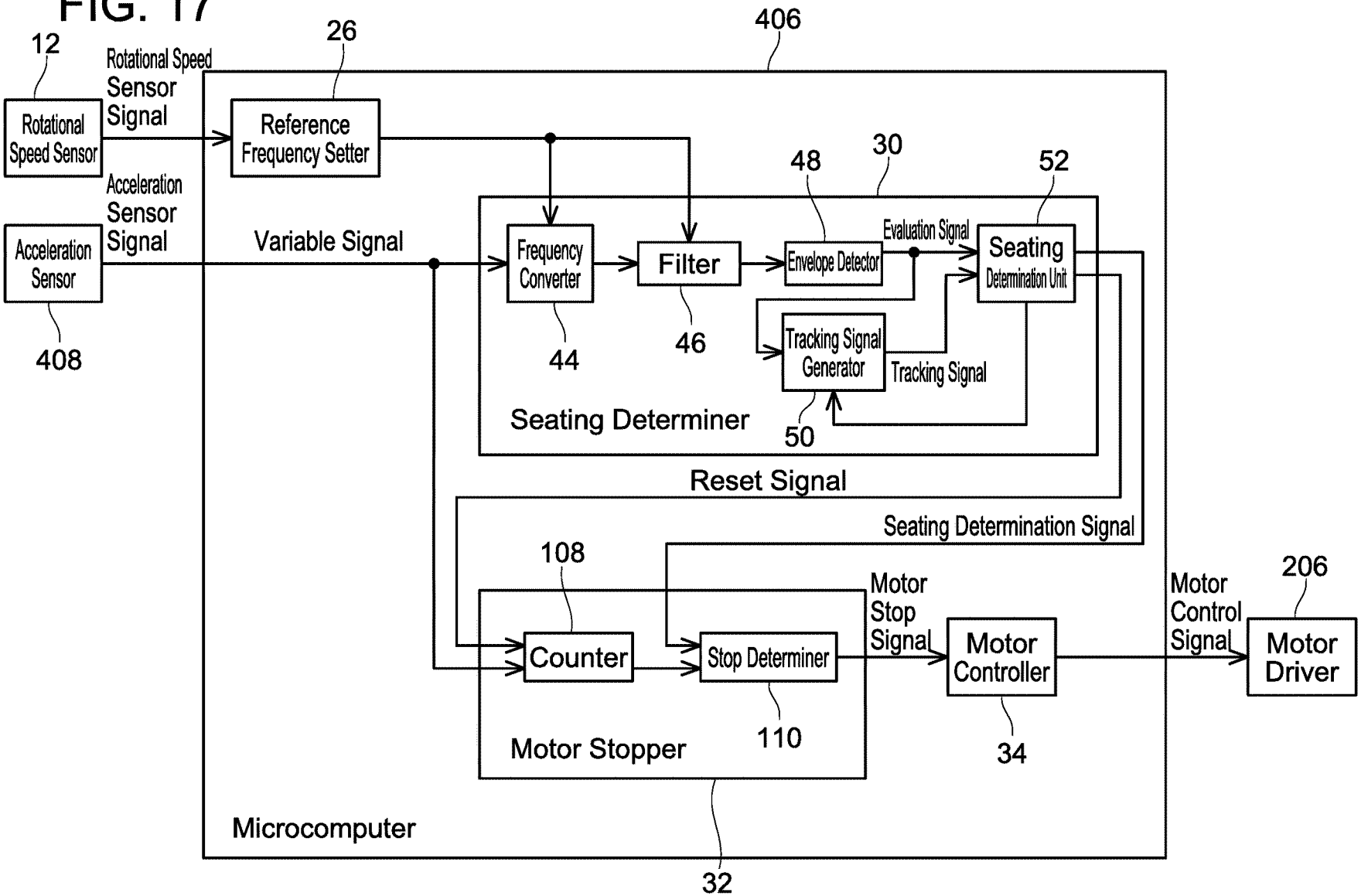
FIG. 17 is a block diagram schematically showing a configuration of a microcomputer 406 of the impact fastening tool 402 of the fourth embodiment.

As shown in FIG. 17, the microcomputer 406 comprises the reference frequency setter 26, the seating determiner 30, the motor stopper 32, and the motor controller 34. The reference frequency setter 26, the seating determiner 30, the motor stopper 32, and the motor controller 34 are the same as those of the impact fastening tool 2 of the first embodiment. The microcomputer 406 does not comprise a signal converter configured to convert a current sensor signal from a current sensor and a rotational speed sensor signal from a rotational speed sensor into a variable signal. In the impact fastening tool 402 of the present embodiment, an acceleration sensor signal from the acceleration sensor 408 is inputted to the seating determiner 30 and the motor stopper 32 as the variable signal which varies in accordance with a hit to the anvil 8 by the hammer 6.

According to the impact fastening tool 402 of the present embodiment, the variable signal can be obtained from the acceleration sensor signal from the acceleration sensor 408 without using a current sensor signal from a current sensor configured to detect a current flowing through the motor 4 and a rotational speed sensor signal from the rotational speed sensor configured to detect a rotational speed of the motor 4, and whether the fastener 16 has been seated or not can be determined based on that variable signal. Due to this, a calculation load for obtaining the variable signal can be reduced.

Fifth Embodiment

Figure 18:
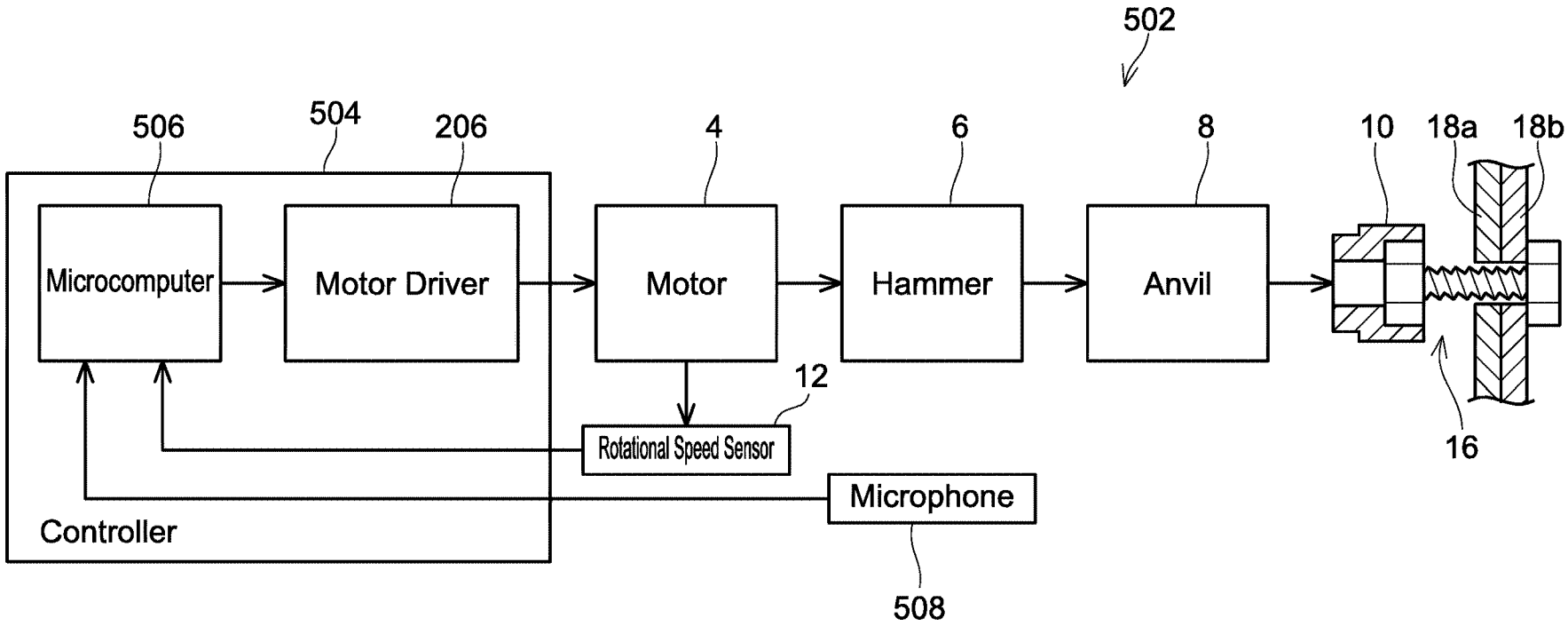
FIG. 18 is a block diagram schematically showing a configuration of an impact fastening tool 502 of a fifth embodiment.

FIG. 18 schematically shows a configuration of an impact fastening tool 502 of an embodiment. The impact fastening tool 502 of the present embodiment comprises almost the same configuration as those of the impact fastening tool 2 of the first embodiment and the impact fastening tool 202 of the second embodiment. Hereinbelow, differences of the impact fastening tool 502 of the present embodiment from the impact fastening tool 2 of the first embodiment and the impact fastening tool 202 of the second embodiment will be described in detail.

The impact fastening tool 502 of the present embodiment comprises the motor 4, the hammer 6, the anvil 8, the bit 10, the rotational speed sensor 12, and a controller 504. The motor 4, the hammer 6, the anvil 8, the bit 10, and the rotational speed sensor 12 are the same as those of the impact fastening tool 2 of the first embodiment. The impact fastening tool 502 of the present embodiment further comprises a microphone 508 which is provided in a vicinity of the hammer 6 and is configured to detect hitting sound generated when the hammer 6 hits the anvil 8. The controller 504 comprises the motor driver 206 and a microcomputer 506. The motor driver 206 does not comprise a current sensor as in the impact fastening tool 202 of the second embodiment.

Figure 19:
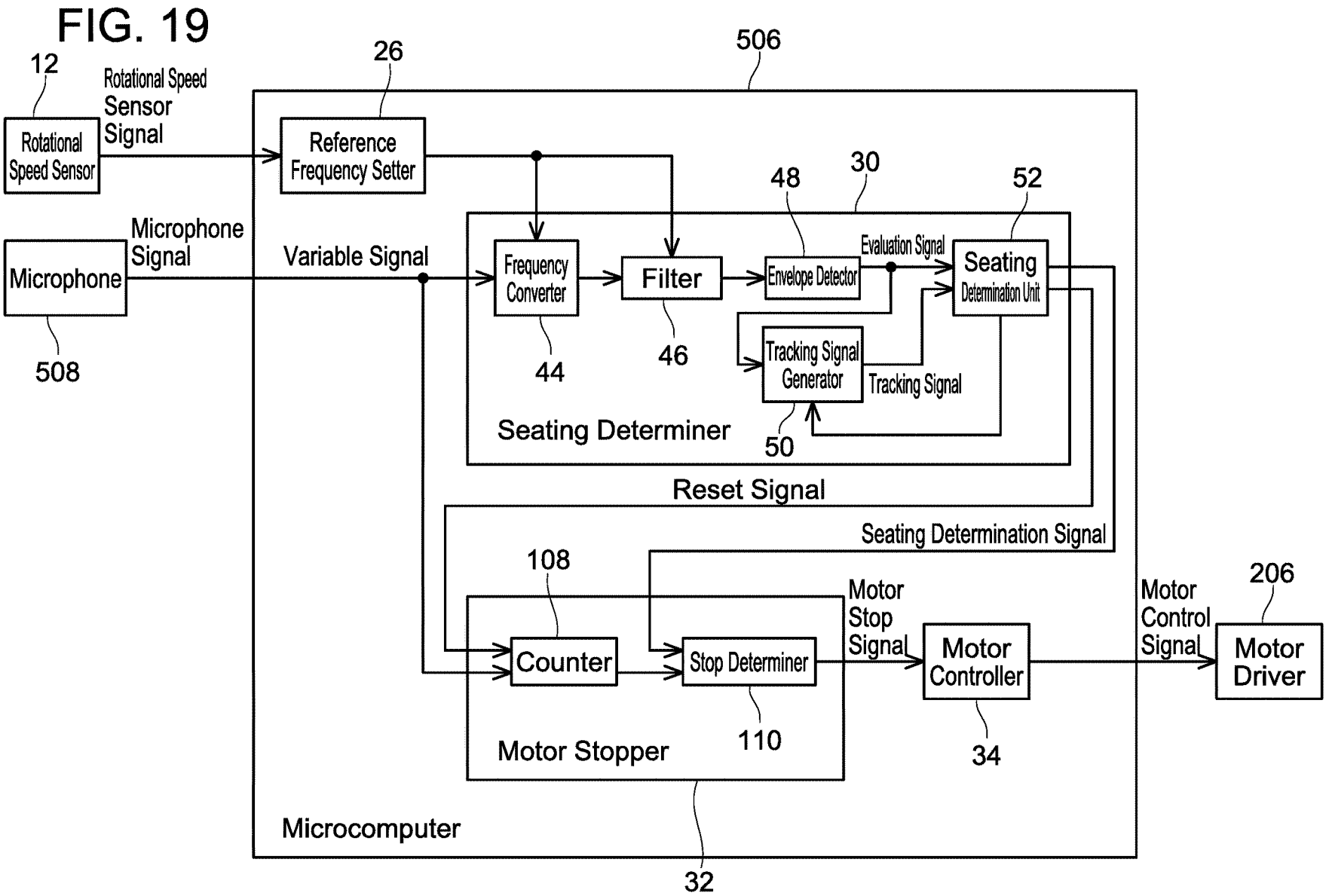
FIG. 19 is a block diagram schematically showing a configuration of a microcomputer 506 of the impact fastening tool 502 of the fifth embodiment.
Figure 20:
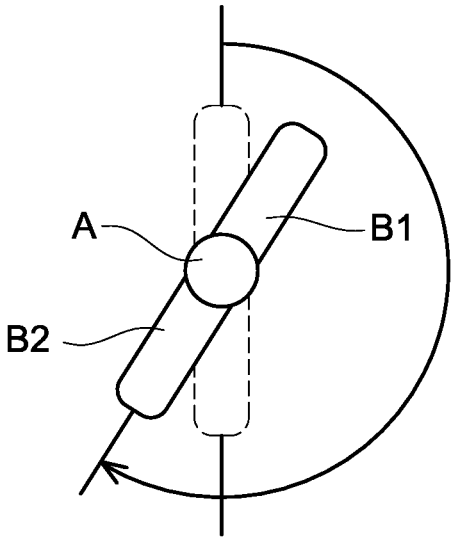
FIG. 20 is a diagram schematically showing a state of an anvil A subjected to a hit by a hammer in a state where a fastener is rotatable.
Figure 21:
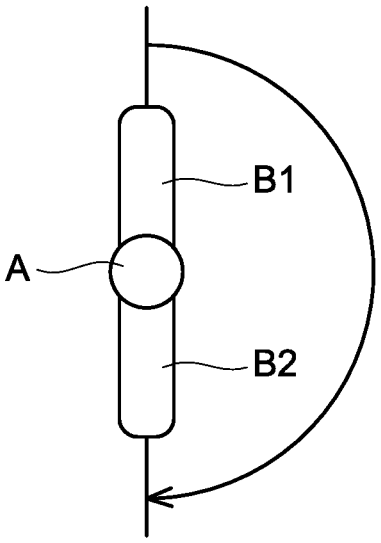
FIG. 21 is a diagram schematically showing a state of the anvil A subjected to a hit by the hammer in a state where the fastener is not rotatable.

As shown in FIG. 19, the microcomputer 506 comprises the reference frequency setter 26, the seating determiner 30, the motor stopper 32, and the motor controller 34. The reference frequency setter 26, the seating determiner 30, the motor stopper 32, and the motor controller 34 are the same as those of the impact fastening tool 2 of the first embodiment. The microcomputer 506 does not comprise a signal converter configured to convert a current sensor signal from a current sensor and a rotational speed sensor signal from a rotational speed sensor into a variable signal. In the impact fastening tool 502 of the present embodiment, a microphone signal from the microphone 508 is inputted to the seating determiner 30 and the motor stopper 32 as the variable signal which varies in accordance with a hit to the anvil 8 by the hammer 6.

According to the impact fastening tool 502 of the present embodiment, the variable signal can be obtained from the microphone signal from the microphone 50 without using a current sensor signal from a current sensor configured to detect a current flowing through the motor 4 and a rotational speed sensor signal from a rotational speed sensor configured to detect a rotational speed of the motor 4, and whether the fastener 16 has been seated or not can be determined based on that variable signal. Due to this, a calculation load for obtaining the variable signal can be reduced.

What is claimed is:

1. An impact fastening tool, comprising:

a motor;

a hammer configured to be rotationally driven by the motor;

an anvil configured to be hit in a rotational direction by the hammer;

a sensor configured to obtain a variable signal representing a current flowing through the motor and which varies according to a hit to the anvil by the hammer; and a computer configured to determine whether or not a fastener has been seated based on a signal component included in the variable signal obtained by the sensor, the signal component corresponding to a predetermined reference frequency.

2. The impact fastening tool according to claim 1, wherein the predetermined reference frequency is set according to a rotational speed of the hammer.

3. The impact fastening tool according to claim 2, wherein the predetermined reference frequency is changeable according to a material of a fastened member.

4. The impact fastening tool according to claim 1, wherein the computer is configured to allow a frequency band including the predetermined reference frequency to pass therethrough for the variable signal.

5. The impact fastening tool according to claim 4, wherein the computer is configured to selectively amplify the frequency band including the predetermined reference frequency.

6. The impact fastening tool according to claim 1, wherein the computer is configured to:

perform frequency conversion for the variable signal;

generate a reference signal having a frequency equal to or higher than the predetermined reference frequency; and multiply the variable signal by the reference signal.

7. The impact fastening tool according to claim 1, wherein the computer is configured to detect an envelope of the variable signal and to output it as an evaluation signal.

8. The impact fastening tool according to claim 1, wherein the computer is configured to:

generate a first reference signal having a frequency equal to or higher than the predetermined reference frequency;

multiply the variable signal by the first reference signal;

generate a second reference signal having a frequency same as the frequency of the first reference signal and having a phase shifted by 90 degrees with respect to a phase of the first reference signal;

multiply the variable signal by the second reference signal; and detect an envelope of the variable signal and output it as an evaluation signal.

9. The impact fastening tool according to claim 7, wherein the computer is configured to:

generate a tracking signal which tracks the evaluation signal;

tentatively determine that the fastener has been seated each time the tracking signal reaches the evaluation signal;

when it is tentatively determined that the fastener has been seated, determine whether the evaluation signal satisfies a predetermined criterion; and when the evaluation signal satisfies the predetermined criterion, determine that the fastener has been seated.

10. The impact fastening tool according to claim 9, wherein the computer is configured to:

generate a deviation signal by calculating a deviation between the evaluation signal and the tracking signal; and tentatively determine that the fastener has been seated each time the deviation signal becomes equal to or less than a predetermined threshold.

11. The impact fastening tool according to claim 10, wherein the computer is configured to:

generate a variable threshold signal based on the evaluation signal and the deviation signal; and determine that the fastener has been seated, when a deviation between the deviation signal and the variable threshold signal becomes equal to or greater than a predetermined value after it was tentatively determined that the fastener had been seated.

12. The impact fastening tool according to claim 9, wherein the computer is configured to:

stop the motor based on a stop determination value which increases as the hammer continues to hit the anvil; and reset the stop determination value when the computer tentatively determines that the fastener has been seated.

13. The impact fastening tool according to claim 12, wherein the computer is configured to stop the motor when it is determined that the fastener has been seated and the stop determination value has reached a predetermined value.

14. The impact fastening tool according to claim 1, wherein the sensor includes a current sensor configured to detect a magnitude of the current flowing through the motor, and the variable signal is obtained based on an output of the current sensor.

* * * * *